US010638224B2

(12) United States Patent
Janse et al.

(10) Patent No.: US 10,638,224 B2
(45) Date of Patent: Apr. 28, 2020

(54) AUDIO CAPTURE USING BEAMFORMING

(71) Applicant: KONINKLIJKE PHILIPS N.V., Eindhoven (NL)

(72) Inventors: Cornelis Pieter Janse, Eindhoven (NL); Brian Brand Antonius Johannes Bloemendal, Deurne (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 16/474,779

(22) PCT Filed: Dec. 20, 2017

(86) PCT No.: PCT/EP2017/083680
§ 371 (c)(1),
(2) Date: Jun. 28, 2019

(87) PCT Pub. No.: WO2018/127412
PCT Pub. Date: Jul. 12, 2018

(65) Prior Publication Data

US 2019/0349678 A1 Nov. 14, 2019

(30) Foreign Application Priority Data

Jan. 3, 2017 (EP) ..... 17150091

(51) Int. Cl.
*H04R 3/00* (2006.01)
*G10L 21/0216* (2013.01)

(52) U.S. Cl.
CPC ..... *H04R 3/005* (2013.01); *G10L 21/0216* (2013.01); *G10L 2021/02166* (2013.01); *H04R 2430/20* (2013.01)

(58) Field of Classification Search
CPC ..... H04R 3/005; H04R 2430/20; H04R 2430/21; H04R 2430/23; H04R 1/406;
(Continued)

(56) References Cited

U.S. PATENT DOCUMENTS 6,774,934 B1 8/2004 Belt et al.
7,146,012 B1 12/2006 Belt et al.
(Continued)

OTHER PUBLICATIONS

Boll "Suppression of Acoustic Noise in Speech Using Spectral Subtraction" IEEE Trans. Acoustics, Speech and Signal Processing, vol. 27, pp. 113-120, Apr. 1979.
(Continued)

*Primary Examiner* — Ahmad F. Matar
*Assistant Examiner* — Sabrina Diaz

(57) ABSTRACT

A beamforming audio capture apparatus comprises a microphone array (301) which is coupled to a first beamformer (303) and a second beamformer (305). The beamformers (303, 305) are filter-and-combine beamformers comprising a plurality of beamform filters each having an adaptive impulse response. A difference processor (309) determines a difference measure between beams of the first beamformer (303) and the second beamformer (305) in response to a comparison of the adaptive impulse responses of the two beamformers (303, 305). The difference measure may e.g. be used to combine the output signals of the beamformers (303, 305). An improved difference measure less sensitive to e.g. diffuse noise may be provided.

17 Claims, 8 Drawing Sheets

(58) Field of Classification Search
CPC .... H04R 25/407; H04R 29/00; H04R 29/005; G10L 3/005; G10L 2021/02166; G10L 2021/401; G10L 2021/403; G10L 15/20; G10L 25/84; G10L 25/93
USPC ..... 381/92, 56
See application file for complete search history.

(56) References Cited

U.S. PATENT DOCUMENTS

| | | | | |
|---|---|---|---|---|
| 7,602,926 | B2 | 10/2009 | Roovers | |
| 10,061,009 | B1 * | 8/2018 | Family | G01S 1/72 |
| 2008/0285772 | A1 * | 11/2008 | Haulick | G01S 7/52003 381/92 |
| 2011/0222372 | A1 | 9/2011 | O'Donovan et al. | |
| 2013/0301837 | A1 | 11/2013 | Kim et al. | |
| 2015/0379990 | A1 | 12/2015 | Nongpiur | |

OTHER PUBLICATIONS

International Search Report From PCT/EP2017/083680 dated Apr. 3, 2018.

* cited by examiner

Prior Art FIG. 1

AUDIO CAPTURE USING BEAMFORMING

CROSS-REFERENCE TO PRIOR APPLICATIONS

This application is the U.S. National Phase application under 35 U.S.C. § 371 of International Application No. PCT/EP2017/083680, filed on Dec. 20, 2017, which claims the benefit of EP Patent Application No. EP 17150091.1, filed on Jan. 3, 2017. These applications are hereby incorporated by reference herein.

FIELD OF THE INVENTION

The invention relates to audio capture using beamforming and in particular, but not exclusively, to speech capture using beamforming.

BACKGROUND OF THE INVENTION

Capturing audio, and in particularly speech, has become increasingly important in the last decades. Indeed, capturing speech has become increasingly important for a variety of applications including telecommunication, teleconferencing, gaming, audio user interfaces, etc. However, a problem in many scenarios and applications is that the desired speech source is typically not the only audio source in the environment. Rather, in typical audio environments there are many other audio/noise sources which are being captured by the microphone. One of the critical problems facing many speech capturing applications is that of how to best extract speech in a noisy environment. In order to address this problem, a number of different approaches for noise suppression have been proposed.

Indeed, research in e.g. hands-free speech communications systems is a topic that has received much interest for decades. The first commercial systems available focused on professional (video) conferencing systems in environments with low background noise and low reverberation time. A particularly advantageous approach for identifying and extracting desired audio sources, such as e.g. a desired speaker, was found to be the use of beamforming based on signals from a microphone array. Initially, microphone arrays were often used with a focused fixed beam but later the use of adaptive beams became more popular.

In the late 1990's, hands-free systems for mobiles started to be introduced. These were intended to be used in many different environments, including reverberant rooms and at high(er) background noise levels. Such audio environments provide substantially more difficult challenges, and in particular may complicate or degrade the adaptation of the formed beam.

Initially, research in audio capture for such environments focused on echo cancellation, and later on noise suppression. An example of an audio capture system based on beamforming is illustrated in FIG. 1. In the example, an array of a plurality of microphones 101 are coupled to a beamformer 103 which generates an audio source signal z(n) and one or more noise reference signal(s) x(n).

The microphone array 101 may in some embodiments comprise only two microphones but will typically comprise a higher number.

The beamformer 103 may specifically be an adaptive beamformer in which one beam can be directed towards the speech source using a suitable adaptation algorithm.

For example, U.S. Pat. Nos. 7,146,012 and 7,602,926 discloses examples of adaptive beamformers that focus on the speech but also provides a reference signal that contains (almost) no speech.

The beamformer creates an enhanced output signal, z(n), by adding the desired part of the microphone signals coherently by filtering the received signals in forward matching filters and adding the filtered outputs. Also, the output signal is filtered in backward adaptive filters having conjugate filter responses to the forward filters (in the frequency domain corresponding to time inversed impulse responses in the time domain). Error signals are generated as the difference between the input signals and the outputs of the backward adaptive filters, and the coefficients of the filters are adapted to minimize the error signals thereby resulting in the audio beam being steered towards the dominant signal. The generated error signals x(n) can be considered as noise reference signals which are particularly suitable for performing additional noise reduction on the enhanced output signal z(n).

The primary signal z(n) and the reference signal x(n) are typically both contaminated by noise. In case the noise in the two signals is coherent (for example when there is an interfering point noise source), an adaptive filter 105 can be used to reduce the coherent noise.

For this purpose, the noise reference signal x(n) is coupled to the input of the adaptive filter 105 with the output being subtracted from the audio source signal z(n) to generate a compensated signal r(n). The adaptive filter 105 is adapted to minimize the power of the compensated signal r(n), typically when the desired audio source is not active (e.g. when there is no speech) and this results in the suppression of coherent noise.

The compensated signal is fed to a post-processor 107 which performs noise reduction on the compensated signal r(n) based on the noise reference signal x(n). Specifically, the post-processor 107 transforms the compensated signal r(n) and the noise reference signal x(n) to the frequency domain using a short-time Fourier transform. It then, for each frequency bin, modifies the amplitude of $R(\omega)$ by subtracting a scaled version of the amplitude spectrum of $X(\omega)$. The resulting complex spectrum is transformed back to the time domain to yield the output signal q(n) in which noise has been suppressed. This technique of spectral subtraction was first described in S. F. Boll, "Suppression of Acoustic Noise in Speech using Spectral Subtraction," IEEE Trans. Acoustics, Speech and Signal Processing, vol. 27, pp. 113-120, April 1979.

In many audio capture systems, a plurality of beamformers may be used with these being able to independently adapt to an audio source. For example, in order to track two different speakers in an audio environment, an audio capturing apparatus may include two independently adaptive beamformers.

In systems using a plurality of independently adaptable beamformers, it may often be advantageous to determine how close the beams of the different beamformers are to each other. For example, when using two beamformers to track two separate speakers, it may be important to ensure that they do not both adapt to track the same speaker. This may e.g. be achieved by determining a difference measure which is indicative of the difference between the beams. If the difference measure indicates that the difference is below a threshold, it may reinitialize one of the beamformers towards a different audio source.

In other systems, an audio capturing apparatus may use interworking beamformers to provide improved audio capture, and in such systems it may be advantageous to determine how close different beams are to each other.

For example, although the system of FIG. 1 provides very efficient operation and advantageous performance in many scenarios, it is not optimum in all scenarios. Indeed, whereas many conventional systems, including the example of FIG. 1, provide very good performance when the desired audio source/speaker is within the reverberation radius of the microphone array, i.e. for applications where the direct energy of the desired audio source is (preferably significantly) stronger than the energy of the reflections of the desired audio source, it tends to provide less optimum results when this is not the case. In typical environments, it has been found that a speaker typically should be within 1-1.5 meter of the microphone array.

However, there is a strong desire for audio based hands-free solutions, applications, and systems where the user may be at further distances from the microphone array. This is for example desired both for many communication and for many voice control systems and applications. Systems providing speech enhancement including dereverberation and noise suppression for such situations are in the field referred to as super hands-free systems.

In more detail, when dealing with additional diffuse noise and a desired speaker outside the reverberation radius the following problems may occur:

- The beamformer may often have problems distinguishing between echoes of the desired speech and diffuse background noise, resulting in speech distortion.
- The adaptive beamformer may converge slower towards the desired speaker. During the time when the adaptive beam has not yet converged, there will be speech leakage in the reference signal, resulting in speech distortion in case this reference signal is used for non-stationary noise suppression and cancellation. The problem increases when there are more desired sources that talk after each other.

A solution to deal with slower converging adaptive filters (due to the background noise) is to supplement this with a number of fixed beams being aimed in different directions as illustrated in FIG. 2. However, this approach is particularly developed for scenarios wherein a desired audio source is present within the reverberation radius. It may be less efficient for audio sources outside the reverberation radius and may often lead to non-robust solutions in such cases, especially if there is also acoustic diffuse background noise.

In particular, in order to control and operate such a system, it is typically important to be able to measure how close the different beams/beamformers are to each other. E.g. it may be important to compare focused and non-focused beamformers to each other to select which beam to use for generating the output audio.

However, generating reliable difference measures may be very difficult in many scenarios, such as specifically when a desired audio source is outside the reverberation radius. Typical difference measures tend to be based on comparing the signal outputs generated by the beamformers, such as e.g. by comparing the signal levels or by correlating the outputs. Another approach is to determine the Direction of Arrival (DoA) of the signal and comparing these to each other.

However, whereas such difference measures may provide acceptable performance in many embodiments, they tend to be suboptimal in many practical scenarios. In particular, they tend to not be optimal in scenarios with high levels of noise and reflections, and specifically in reverberating environments wherein the desired audio source is outside the reverberation radius.

This can be understood as follows: in case the desired audio source is outside the reverberation radius, the energy of the direct sound field is small when compared to the energy of the diffuse sound field created from reflections. The direct sound field to diffuse sound field ratio will further degrade if there is also diffuse background noise. The energies of the different beams will be approximately the same and accordingly this does not provide a suitable indication of the similarity of the beams. For the same reason, a system based on measuring the DoA will not be robust: due to the low energy of the direct field, cross-correlating the signals will not give a sharp distinct peak and will result in large errors. For the same reason, direct correlations of the signals are unlikely to provide a clear indication. Making the detectors more robust will often result in missed detections of desired audio source leading to non-focused beams. The typical result is speech leakage in the noise reference, and severe distortion will occur if it is attempted to reduce the noise in the primary signal based on the noise reference signal.

Hence, an improved audio capture approach would be advantageous, and in particular an approach providing an improved difference measure between different beams would be advantageous. Specifically, an approach allowing reduced complexity, increased flexibility, facilitated implementation, reduced cost, improved audio capture, improved suitability for capturing audio outside the reverberation radius, reduced noise sensitivity, improved speech capture, improved accuracy of a difference measure, improved control, and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a beamforming audio capture apparatus comprising: a microphone array; first beamformer coupled to the microphone array and arranged to generate a first beamformed audio output, the first beamformer being a filter-and-combine beamformer comprising a first plurality of beamform filters each having a first adaptive impulse response; a second beamformer coupled to the microphone array and arranged to generate a second beamformed audio output, the second beamformer being a filter-and-combine beamformer comprising a second plurality of beamform filters each having a second adaptive impulse response; and a difference processor for determining a difference measure between beams of the first beamformer and the second beamformer in response to a comparison of the first adaptive impulse responses to the second adaptive impulse responses.

The invention may in many scenarios and applications provide an improved indication of the difference/similarity between beams formed by two beamformers. In particular, an improved difference measure may often be provided in scenarios wherein the direct path from audio sources to which the beamformers adapt are not dominant. Improved performance for scenarios comprising a high degree of diffuse noise, reverberant signals and/or late reflections can often be achieved.

The audio capturing apparatus may in many embodiments comprise an output unit for generating an audio output signal in response to the first beamformed audio output, the second beamformed audio output, and the difference measure. For example, the output unit may comprise a combiner for combining the first and second beamformed audio outputs in response to the difference measure. However, it will be appreciated that the difference measure may be used for many other purposes in other applications, such as for example for selecting between different beams, for controlling the adaptation of the beamformers etc.

The approach may reduce the sensitivity of properties of the audio signals (whether the beamformed audio output or the microphone signals) and may accordingly be less sensitive to e.g. noise. In many scenarios, the difference measure may be generated faster, and e.g. in some scenarios instantaneously. In particular, the difference measure may be generated based on the current filter parameters without any averaging.

The filter-and-combine beamformers may comprise a beamform filter for each microphone and a combiner for combining the outputs of the beamform filters to generate the beamformed audio output signal. The combiner may specifically be a summation unit, and the filter-and-combine beamformers may be filter- and sum-beamformers.

The beamformers are adaptive beamformers and may comprise adaptation functionality for adapting the adaptive impulse responses (thereby adapting the effective directivity of the microphone array).

A difference measure is equivalent to a similarity measure.

The filter-and-combine beamformers may specifically comprise beamform filters in the form of Finite Response Filters (FIRs) having a plurality of coefficients.

In accordance with an optional feature of the invention, the difference processor is arranged to for each microphone of the microphone array determine a correlation between the first and second adaptive impulse responses for the microphone and to determine the difference measure in response to a combination of correlations for each microphone of the microphone array.

This may provide a particularly advantageous difference measure without requiring excessive complexity.

In accordance with an optional feature of the invention, the difference processor is arranged to determine frequency domain representations of the first adaptive impulse responses and of the second adaptive impulse responses; and to determine the difference measure in response to the frequency domain representations of the first adaptive impulse responses and of the second adaptive impulse responses.

This may further improve performance and/or facilitate operation. It may in many embodiments facilitate the determination of the difference measure. In some embodiments, the adaptive impulse responses may be provided in the frequency domain and the frequency domain representations may be readily available. However, in most embodiments, the adaptive impulse responses may be provided in the time domain, e.g. by coefficients of a FIR filter, and the difference processor may be arranged to apply e.g. a Discrete Fourier Transform (DFT) to the time domain impulse responses to generate the frequency representations.

In accordance with an optional feature of the invention, the difference processor is arranged to determine frequency difference measures for frequencies of the frequency domain representations; and to determine the difference measure in response to the frequency difference measures for the frequencies of the frequency domain representations; the difference processor being arranged to determine a frequency difference measure for a first frequency and a first microphone of the microphone array in response to a first frequency domain coefficient and a second frequency domain coefficient, the first frequency domain coefficient being a frequency domain coefficient for the first frequency for the first adaptive impulse response for the first microphone and the second frequency domain coefficient being a frequency domain coefficient for the first frequency for the second adaptive impulse response for the first microphone; and the difference processor further being arranged to determine the frequency difference measure for the first frequency in response to a combination of frequency difference measures for a plurality of microphones of the microphone array.

This may provide a particularly advantageous difference measure which in particular may provide an accurate indication of the difference between the beams.

Denoting, the first and second frequency components for a frequency ω and microphone m as $F_{1m}(e^{j\omega})$ and $F_{2m}(e^{j\omega})$ respectively, the frequency difference measure for the frequency ω and microphone m may be determined as:

$$S_{\omega,m}=f_1(F_{1m}(e^{j\omega}),F_{2m}(e^{j\omega}))$$

The (combined) frequency difference measure for the frequency ω for the plurality of microphones of the microphone array may be determined by combining the values for the difference microphones. For example, for a simple summation over M microphones:

$$S_\omega = \sum_{m=1}^{M} S_{\omega,m}$$

The overall difference measure may then be determined by combining the individual frequency difference measures. For example, a frequency dependent combination may be applied:

$$S=\int_{\omega=0}^{2\pi} w(e^{j\omega})S_\omega d\omega$$

where $w(e^{j\omega})$ is a suitable frequency weighting function.

In accordance with an optional feature of the invention, the difference processor is arranged to determine the frequency difference measure for the first frequency and the first microphone in response to a multiplication of the first frequency domain coefficient and a conjugate of the second frequency domain coefficient.

This may provide a particularly advantageous difference measure which in particular may provide an accurate indication of the difference between the beams. In some embodiments, the frequency difference measure for the frequency ω and microphone m may be determined as:

$$S_{\omega,m}=f_2((F_{1m}(e^{j\omega})\cdot F^*_{2m}(e^{j\omega})))$$

In accordance with an optional feature of the invention, the difference processor is arranged to determine the frequency difference measure for the first frequency in response to a real part of the combination of frequency difference measures for the first frequency for the plurality of microphones of the microphone array.

This may provide a particularly advantageous difference measure which in particular may provide an accurate indication of the difference between the beams.

In accordance with an optional feature of the invention, the difference processor is arranged to determine the frequency difference measure for the first frequency in response to a norm of the combination of frequency difference measures for the first frequency for the plurality of microphones of the microphone array.

This may provide a particularly advantageous difference measure which in particular may provide an accurate indication of the difference between the beams. The norm may specifically be an L1 norm.

In accordance with an optional feature of the invention, the difference processor is arranged to determine the frequency difference measure for the first frequency in response to at least one of a real part and a norm of the combination of frequency difference measures for the first frequency for the plurality of microphones of the microphone array relative to a sum of a function of an L2 norm for a sum of the first frequency domain coefficients and a function of an L2 norm for a sum of the second frequency domain coefficients for the plurality of microphones of the microphone array.

This may provide a particularly advantageous difference measure which in particular may provide an accurate indication of the difference between the beams. The monotonic functions may specifically be square functions.

In accordance with an optional feature of the invention, the difference processor is arranged to determine the frequency difference measure for the first frequency in response to a norm of the combination of frequency difference measures for the first frequency for the plurality of microphones of the microphone array relative to a product of a function of an L2 norm for a sum of the first frequency domain coefficients and a function of an L2 norm for a sum of the second frequency domain coefficients for the plurality of microphones of the microphone array.

This may provide a particularly advantageous difference measure which in particular may provide an accurate indication of the difference between the beams. The monotonic functions may specifically be an absolute value function.

In accordance with an optional feature of the invention, the difference processor is arranged to determine the difference measure as a frequency selective weighted sum of the frequency difference measures.

This may provide a particularly advantageous difference measure which in particular may provide an accurate indication of the difference between the beams. In particular, it may provide an emphasis of particularly perceptually significant frequencies, such as an emphasis of speech frequencies.

In accordance with an optional feature of the invention, the first plurality of beamform filters and the second plurality of beamform filters are finite impulse response filters having a plurality of coefficients.

This may provide efficient operation and implementation in many embodiments.

In accordance with an optional feature of the invention, the beamforming audio capture apparatus further comprises: a plurality of constrained beamformers coupled to the microphone array and each arranged to generate a constrained beamformed audio output, each constrained beamformer of the plurality of constrained beamformers being constrained to form beams in a region different from regions of other constrained beamformers from the plurality of constrained beamformers, the second beamformer being a constrained beamformer of the plurality of constrained beamformers; a first adapter for adapting beamform parameters of the first beamformer; a second adapter for adapting constrained beamform parameters for the plurality of constrained beamformers; wherein the second adapter is arranged to adapt constrained beamform parameters only for constrained beamformers of the plurality of constrained beamformers for which a difference measure has been determined that meets a similarity criterion.

The invention may provide improved audio capture in many embodiments. In particular, improved performance in reverberant environments and/or for audio sources at further distances may often be achieved. The approach may in particular provide improved speech capture in many challenging audio environments. In many embodiments, the approach may provide reliable and accurate beam forming while at the same time providing fast adaptation to new desired audio sources. The approach may provide an audio capturing apparatus having reduced sensitivity to e.g. noise, reverberation, and reflections. In particular, improved capture of audio sources outside the reverberation radius can often be achieved.

In some embodiments, an output audio signal from the audio capturing apparatus may be generated in response to the first beamformed audio output and/or the constrained beamformed audio output. In some embodiments, the output audio signal may be generated as a combination of the constrained beamformed audio output, and specifically a selection combining selecting e.g. a single constrained beamformed audio output may be used.

The difference measure may reflect the difference between the formed beams of the first beamformer and of the constrained beamformer for which the difference measure is generated, e.g. measured as a difference between directions of the beams. In some embodiments, the difference measure may be indicative of a difference between the beamform filters of the first beamformer and of the constrained beamformer. The difference measure may be a distance measure, such as e.g. a measure determined as the distance between vectors of the coefficients of the beamform filters of the first beamformer and the constrained beamformer.

It will be appreciated that a similarity measure may be equivalent to a difference measure in that a similarity measure by providing information relating to the similarity between two features inherently also provides information relating the difference between these, and vice versa.

The similarity criterion may for example comprise a requirement that the difference measure is indicative of a difference being below a given measure, e.g. it may be required that a difference measure having increasing values for increasing difference is below a threshold.

The regions may be dependent on the beamforming for a plurality of paths and are typically not limited to angular direction of arrival regions. For example, regions may be differentiated based on the distance to the microphone array. The constraint of the constrained beamformers to form beams in different regions may be by constraining filter parameters of the beamform filters of the constrained beamformers such that the constrained range of filter parameters (e.g. ranges for filter coefficients) are different for different constrained beamformers.

Adaptation of the beamformers may be by adapting filter parameters of the beamform filters of the beamformers, such as specifically by adapting filter coefficients. The adaptation may seek to optimize (maximize or minimize) a given adaptation parameter, such as e.g. maximizing an output signal level when an audio source is detected or minimizing it when only noise is detected. The adaptation may seek to modify the beamform filters to optimize a measured parameter.

The second adapter may be arranged to adapt constrained beamform parameters of the second beamformers only if the difference measure meets a similarity criterion.

In accordance with an optional feature of the invention, the beamforming audio capture apparatus further comprises an audio source detector for detecting point audio sources in the second beamformed audio outputs; and wherein the second adapter is arranged to adapt constrained beamform parameters only for constrained beamformers for which a presence of a point audio source is detected in the constrained beamformed audio output.

This may further improve performance, and may e.g. provide a more robust performance resulting in improved audio capture. Different criteria may be used to detect a point audio source in different embodiments. A point audio source may specifically be a correlated audio source for the microphones of the microphone array. A point audio source may for example be considered to be detected if a correlation between the microphone signals from the microphone array (e.g. after filtering by the beamform filters of the constrained beamformer) exceeds a given threshold.

According to an aspect of the invention there is provided a method of operation for a beamforming audio capture apparatus comprising: a microphone array;

a first beamformer coupled to the microphone array, the first beamformer being a filter-and-combine beamformer comprising a first plurality of beamform filters each having a first adaptive impulse response; a second beamformer coupled to the microphone array, the second beamformer being a filter-and-combine beamformer comprising a second plurality of beamform filters each having an adaptive impulse response; the method comprising: the first beamformer generating a first beamformed audio output; the second beamformer generating a second beamformed audio output; and determining the difference measure between beams of the first beamformer and the second beamformer in response to a comparison of the first adaptive impulse responses to the second adaptive impulse responses.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a speech capturing audio system based on beamforming but it will be appreciated that the approach is applicable to many other systems and scenarios for audio capturing.

Figure 3:
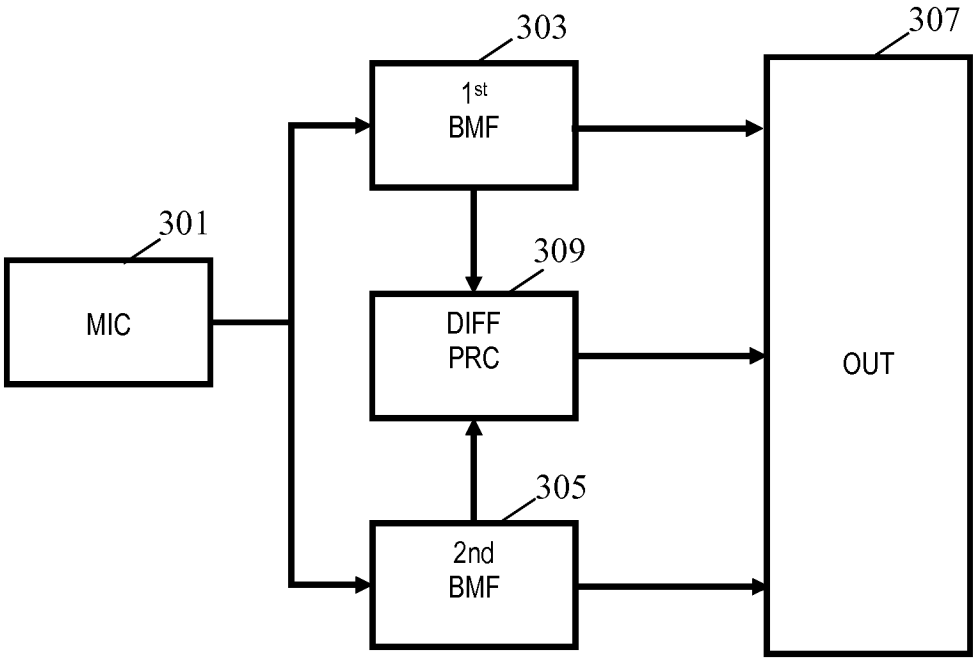
FIG. 3 illustrates an example of elements of an audio capturing apparatus in accordance with some embodiments of the invention.

FIG. 3 illustrates an example of some elements of an audio capturing apparatus in accordance with some embodiments of the invention.

The audio capturing apparatus comprises a microphone array 301 which comprises a plurality of microphones arranged to capture audio in the environment.

The microphone array 301 is coupled to a first beamformer 303 (typically either directly or via an echo canceller, amplifiers, digital to analog converters etc. as will be well known to the person skilled in the art).

The first beamformer 303 is arranged to combine the signals from the microphone array 301 such that an effective directional audio sensitivity of the microphone array 301 is generated. The first beamformer 303 thus generates an output signal, referred to as the first beamformed audio output, which corresponds to a selective capturing of audio in the environment. The first beamformer 303 is an adaptive beamformer and the directivity can be controlled by setting parameters, referred to as first beamform parameters, of the beamform operation of the first beamformer 303, and specifically by setting filter parameters (typically coefficients) of beamform filters.

The microphone array 301 is further coupled to a second beamformer 305 (typically either directly or via an echo canceller, amplifiers, digital to analog converters etc. as will be well known to the person skilled in the art).

The second beamformer 305 is similarly arranged to combine the signals from the microphone array 301 such that an effective directional audio sensitivity of the microphone array 301 is generated. The second beamformer 305 thus generates an output signal, referred to as the second beamformed audio output, which corresponds to a selective capturing of audio in the environment. The second beamformer 305 is also an adaptive beamformer and the directivity can be controlled by setting parameters, referred to as second beamform parameters, of the beamform operation of the second beamformer 305, and specifically by setting filter parameters (typically coefficients) of beamform filters.

The first and second beamformer 303, 305 are accordingly adaptive beamformers where the directivity can be controlled by adapting the parameters of the beamform operation.

Specifically, the beamformers 303, 305 are filter-and-combine (or specifically in most embodiments filter-and-sum) beamformers. A beamform filter may be applied to each of the microphone signals and the filtered outputs may be combined, typically by simply being added together.

In most embodiments, each of the beamform filters has a time domain impulse response which is not a simple Dirac pulse (corresponding to a simple delay and thus a gain and phase offset in the frequency domain) but rather has an impulse response which typically extends over a time interval of no less than 2, 5, 10 or even 30 msec.

The impulse responses may often be implemented by the beamform filters being FIR (Finite Impulse Response) filters with a plurality of coefficients. The beamformers 303, 305 may in such embodiments adapt the beamforming by adapting the filter coefficients. In many embodiments, the FIR filters may have coefficients corresponding to fixed time offsets (typically sample time offsets) with the adaptation being achieved by adapting the coefficient values. In other embodiments, the beamform filters may typically have substantially fewer coefficients (e.g. only two or three) but with the timing of these (also) being adaptable.

A particular advantage of the beamform filters having extended impulse responses rather than being a simple variable delay (or simple frequency domain gain/phase adjustment) is that it allows the beamformers 303, 305 to not only adapt to the strongest, typically direct, signal component. Rather, it allows the beamformers 303, 305 to adapt to include further signal paths corresponding typically to reflections. Accordingly, the approach allows for improved performance in most real environments, and specifically allows improved performance in reflecting and/or reverberating environments and/or for audio sources further from the microphone array 301.

It will be appreciated that different adaptation algorithms may be used in different embodiments and that various optimization parameters will be known to the skilled person. For example, the beamformers 303, 305 may adapt the beamform parameters to maximize the output signal value of the beamformers 303, 305. As a specific example, consider a beamformer where the received microphone signals are filtered with forward matching filters and where the filtered outputs are added. The output signal is filtered by backward adaptive filters, having conjugate filter responses to the forward filters (in the frequency domain corresponding to time inversed impulse responses in the time domain. Error signals are generated as the difference between the input signals and the outputs of the backward adaptive filters, and the coefficients of the filters are adapted to minimize the error signals thereby resulting in the maximum output power. Further details of such an approach can be found in U.S. Pat. Nos. 7,146,012 and 7,602,926.

It is noted that in approaches such as that of U.S. Pat. Nos. 7,146,012 and 7,602,926 are based on the adaptation being based both on the audio source signal z(n) and the noise reference signal(s) x(n) from the beamformers, and it will be appreciated that the same approach may be used for the system of FIG. 3.

Figure 1:
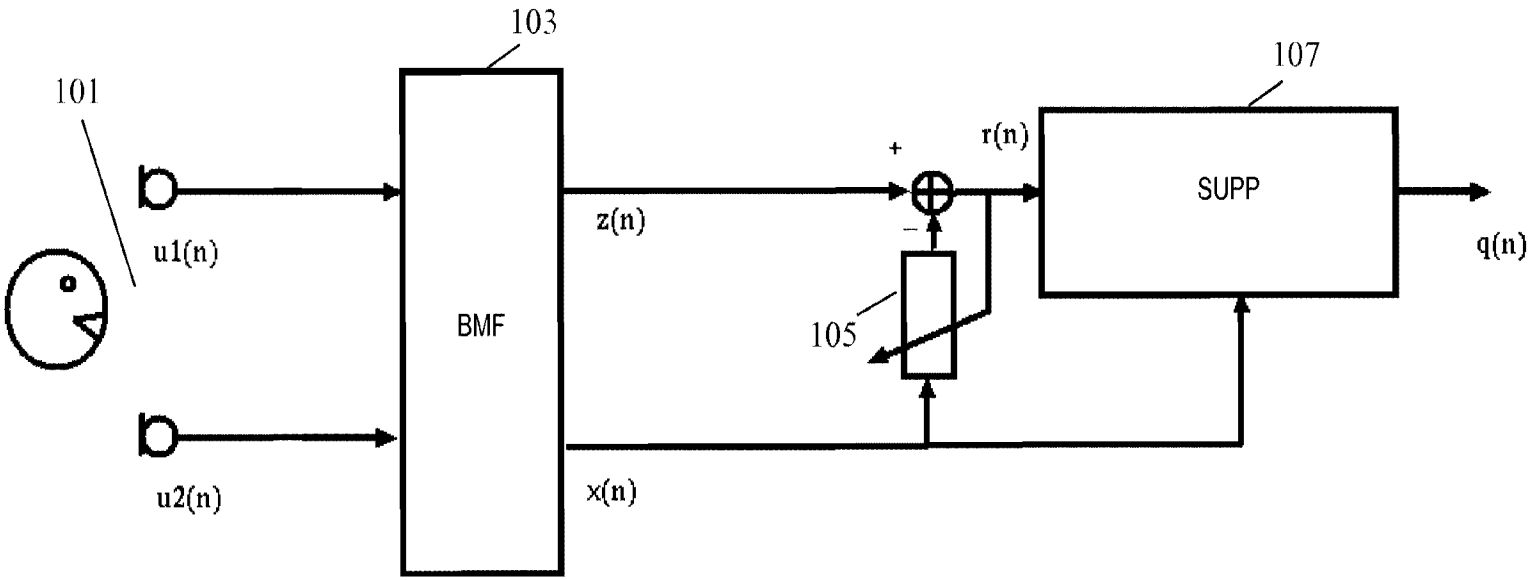
FIG. 1 illustrates an example of elements of a beamforming audio capturing system.

The beamformers 303, 305 may indeed specifically be beamformers corresponding to the one illustrated in FIG. 1 and disclosed in U.S. Pat. Nos. 7,146,012 and 7,602,926.

The beamformers 303, 305 are in the example coupled to an (optional) output processor 307 which receives the beamformed audio output signals from the beamformers 303, 305. The exact output generated from the audio capturing apparatus will depend on the specific preferences and requirements of the individual embodiment. Indeed, in some embodiments, the output from the audio capturing apparatus may simply consist in the audio output signals from the beamformers 303, 305.

In many embodiments, the output signal from the output processor 307 is generated as a combination of the audio output signals from the beamformers 303, 305. Indeed, in some embodiments, a simple selection combining may be performed, e.g. selecting the audio output signals for which the signal to noise ratio, or simply the signal level, is the highest.

Thus, the output selection and post-processing of the output processor 307 may be application specific and/or different in different implementations/embodiments. For example, all possible focused beam outputs can be provided, a selection can be made based on a criterion defined by the user (e.g. the strongest speaker is selected), etc.

For a voice control application, for example, all outputs may be forwarded to a voice trigger recognizer which is arranged to detect a specific word or phrase to initialize voice control. In such an example, the audio output signal in which the trigger word or phrase is detected may following the trigger phrase be used by a voice recognizer to detect specific commands.

For communication applications, it may for example be advantageous to select the audio output signal that is strongest and e.g. for which the presence of a specific point audio source has been found.

In some embodiments, post-processing such as the noise suppression of FIG. 1, may be applied to the output of the audio capturing apparatus (e.g. by the output processor 307). This may improve performance for e.g. voice communication. In such post-processing, non-linear operations may be included although it may e.g. for some speech recognizers be more advantageous to limit the processing to only include linear processing.

In many systems utilizing a plurality of beamformers it may be advantageous to be able to determine whether the beamformers have formed beams that are close to each other. In the system of FIG. 3, the audio capturing apparatus comprises a difference processor 309 which is arranged to determine a difference measure which is indicative of a difference between the beams formed by the first beamformer 303 and the second beamformer 305.

It will be appreciated that the use of such a difference measure may be different for different applications and implementations and that the principles are not limited to a specific application. In the specific example of FIG. 3, the difference processor 309 is coupled to the output processor 307 and is used in the generation of an audio output from the output processor 307. For example, if the difference measure indicates that the two beams are very close to each other, an output audio signal may be generated by summing or averaging the output signals (e.g. in the frequency domain). If the difference measure is indicative of a large difference (and thus indicating that the two beams are adapted to different audio sources), the output processor 307 may generate the output audio signal by selecting the beamformed audio output signal that has the highest energy level.

In conventional approaches for comparing beamformers and beams, the similarity between beams is assessed by comparing the generated audio outputs. For example, a cross correlation between the audio outputs may be generated with the similarity being indicated by the magnitude of the correlation. In some systems, a DoA may be determined by cross correlating the audio signals for a microphone pair and determining the DoA in response to a timing of the peak.

In the system of FIG. 3, the difference measure is not merely determined based on a property or comparison of audio signals, whether the beamformed audio output signals from the beamformers or the input microphone signals, but rather, the difference processor 309 of the audio capturing apparatus of FIG. 3 is arranged to determine the difference measure in response to a comparison of the impulse responses of the beamform filters of the first and second beamformers 303, 305.

Figure 4:
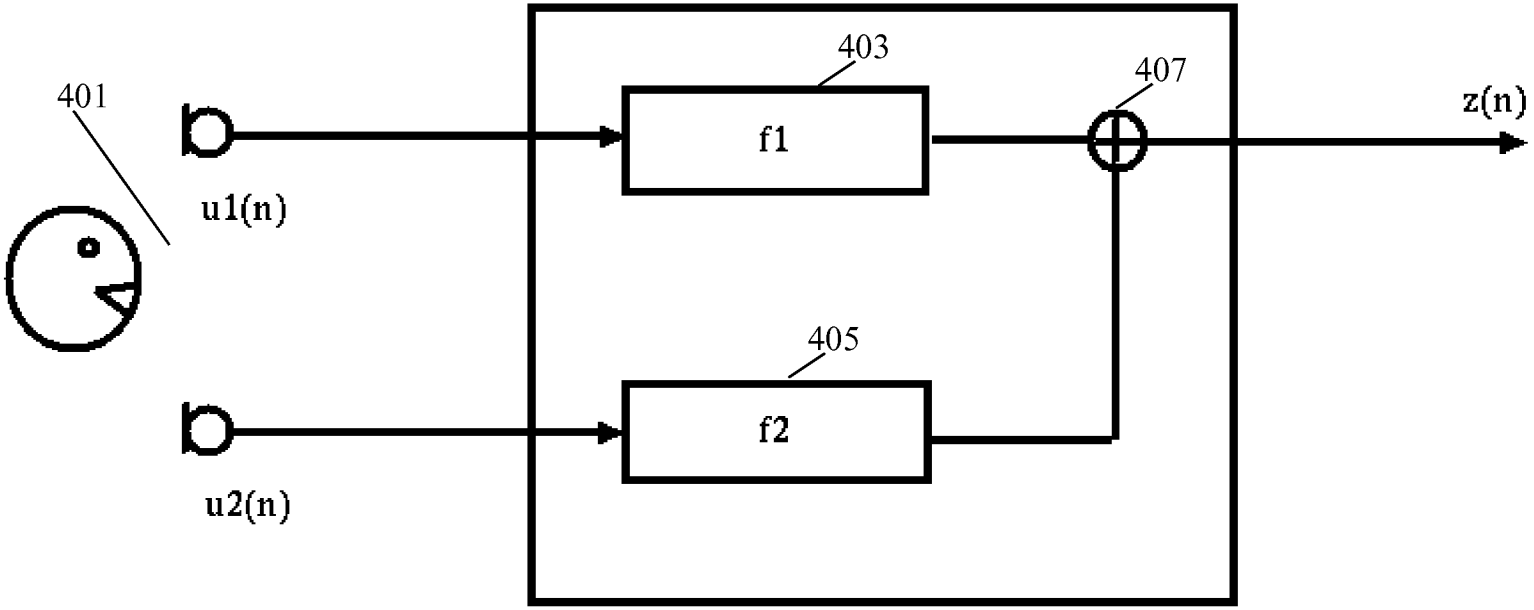
FIG. 4 illustrates an example of elements of a filter-and-sum beamformer.

FIG. 4 illustrates a simplified example of a filter-and-sum beamformer based on a microphone array comprising only two microphones 401. In the example, each microphone 401 is coupled to a beamform filter 403, 405, the outputs of which are summed in summer 407 to generate a beamformed audio output signal. The beamform filters 403, 405 have impulse responses f1 and f2 which are adapted to form a beam in a given direction. It will be appreciated that typically the microphone array will comprise more than two microphones and that the principle of FIG. 4 is easily extended to more microphones by further including a beamform filter for each microphone.

The first and second beamformers 303, 305 may include such a filter-and-sum architecture for beamforming (as e.g. in the beamformers of U.S. Pat. Nos. 7,146,012 and 7,602,926). It will be appreciated that in many embodiments, the microphone array 301 may however comprise more than two microphones. Further, it will be appreciated that the beamformers 303, 305 include functionality for adapting the beamform filters as previously described. Also, in the specific example, the beamformers 303, 305 generate not only a beamformed audio output signal but also a noise reference signal.

In the system of FIG. 3, the parameters of the beamform filters for the first beamformer 303 are compared to the parameters of the beamform filters of the second beamformer 305. The difference measure may then be determined to reflect how close these parameters are to each other. Specifically, for each microphone the corresponding beamform filters of the first beamformer 303 and the second beamformer 305 are compared to each other to generate an intermediate difference measure. The intermediate difference measures are then combined into a single difference measure being output from the difference processor 309.

The beamform parameters being compared are typically the filter coefficients. Specifically, the beamform filters may be FIR filters having a time domain impulse response defined by the set of FIR filter coefficients. The difference processor 309 may be arranged to compare the corresponding filters of the first beamformer 303 and the second beamformer 305 by determining a correlation between the filters. A correlation value may be determined as the maximum correlation (i.e. the correlation value for the time offset maximizing the correlation).

The difference processor 309 may then combine all these individual correlation values into a single difference measure, e.g. simply by summing these together. In other embodiments, a weighted combination may be performed, e.g. by weighting larger coefficients higher than lower coefficients.

It will be appreciated that such a difference measure will have an increasing value for an increasing correlation of the filters, and thus that a higher value will be indicative of an increased similarity of the beams rather than an increased difference. However, in embodiments wherein it is desired for the difference measure to increase for increasing difference, a monotonically decreasing function can simply be applied to the combined correlation.

The determination of the difference measure based on a comparison of impulse responses of the beamform filters rather than based on audio signals (the beamformed audio output signals or the microphone signals) provide significant advantages in many systems and applications. In particular, the approach typically provides much improved performance, and indeed is suitable for application in reverberant audio environments and for audio sources at further distances including in particular audio sources outside the reverberation radius. Indeed, it provides much improved performance in scenarios wherein the direct path from an audio source is not dominant but rather where the direct path and possibly early reflections are dominated by e.g. a diffuse sound field. In particular, in such scenarios difference estimation based on the audio signal will be heavily subject to the spatial and temporal characteristics of the sound field whereas the filter based approach allows for a more direct assessment of the beams based on the filter parameters which not only reflect the direct sound field/path but are adapted to reflect the direct sound field/path and early reflections (due to the impulse responses having an extended duration to take these reflections into account).

Indeed, whereas conventional DoA and audio signal correlation metrics for estimating the similarity of two beamformers are based on anechoic environments, and accordingly work well in environments where the desired users are close to the microphones (within the reverberation radius) such that the energy of the diffuse sound field dominates, the approach of FIG. 3 is not based on such assumptions and provide excellent estimation even in the presence of many reflections and/or substantial diffuse acoustic noise.

Other advantages include that the difference measure can be determined instantly based on the current beamform parameters, and specifically based on the current filter coefficients. There is in most embodiments no need for any averaging of the parameters, rather the adaptation speed of the adaptive beamformers determines the tracking behavior.

A particularly advantageous aspect is that the comparison and the difference measure can be based on impulse responses that have an extended duration. This allows for the difference measure to reflect not merely a delay of a direct path or an angular direction of the beam but rather allows for a significant part, or indeed all, of the estimated acoustic room impulse to be taken into account. Thus, the difference measure is not merely based on the subspace excited by the microphone signals as in conventional approaches.

In some embodiments, the difference measure may specifically be arranged to compare the impulse responses in the frequency domain rather than in the time domain. Specifically, the difference processor 309 may be arranged to transform the adaptive impulse responses of the filters of the first beamformer 303 into the frequency domain. Likewise, the difference processor 309 may be arranged to transform the adaptive impulse responses of the filters of the second beamformer 305 into the frequency domain. The transformation may specifically be performed by applying e.g. a Fast Fourier Transform (FFT) to the impulse responses of the beamform filters of both the first beamformer 303 and the second beamformer 305.

The difference processor 309 may accordingly for each filter of the first beamformer 303 and the second beamformer 305 generate a set of frequency domain coefficients. It may then proceed to determine the difference measure based on the frequency representation. For example, for each microphone of the microphone array 301, the difference processor 309 may compare the frequency domain coefficients of the two beamform filters. As a simple example, it may simply determine a magnitude of a difference vector calculated as the difference between the frequency domain coefficient vectors for the two filters. The difference measure may then be determined by combining the intermediate difference measures generated for the individual frequencies.

In the following, some specific and highly advantageous approaches for determining a difference measure will be described. The approaches are based on a comparison of the adaptive impulse responses in the frequency domain. In the approach, the difference processor 309 is arranged to determine frequency difference measures for frequencies of the frequency domain representations. Specifically, a frequency difference measure may be determined for each frequency in the frequency representation. The output difference measure is then generated from these individual frequency difference measures.

A frequency difference measure may specifically be generated for each frequency filter coefficient of each filter pair of beamform filters, where a filter pair represents the filters of respectively the first beamformer 303 and the second beamformer 305 for the same microphone. The frequency difference measure for this frequency coefficient pair is generated as a function of the two coefficients. Indeed, in some embodiments, the frequency difference measure for the coefficient pair may be determined as the absolute difference between the coefficients.

However, for real valued time domain coefficients (i.e. a real valued impulse response), the frequency coefficients will generally be complex values, and in many applications a particularly advantageous frequency difference measure for a pair of coefficients is determined in response to multiplication of a first frequency domain coefficient and a conjugate of the second frequency domain coefficient (i.e. in response to the multiplication of the complex coefficient of one filter and the conjugate of the complex coefficient of the other filter of the pair).

Thus, for each frequency bin of the frequency domain representations of the impulse responses of the beamform filters, a frequency difference measure may be generated for each microphone/filter pair. The combined frequency difference measure for the frequency may then be generated by combining these microphone specific frequency difference measures for all microphones, e.g. simply by summing them.

In more detail, the beamformers 303, 305 may comprise frequency domain filter coefficients for each microphone and for each frequency of the frequency domain representation.

For the first beamformer 303 these coefficients may be denoted $F_{11}(e^{j\omega}) \ldots F_{1M}(e^{j\omega})$ and for the second beamformer 305 they may be denoted $F_{21}(e^{j\omega}) \ldots F_{2M}(e^{j\omega})$ where M is the number of microphones.

The total set of beamform frequency domain filter coefficients for a certain frequency and for all microphones may for the first beamformer 303 and second beamformer 305 respectively be denoted as $f^1$ and $f^2$.

In this case, the frequency difference measure for a given frequency and may be determined as:

$$S(\omega)=f(f^1,f^2)$$

By multiplying the complex-valued filter coefficients that belong to the same microphones we obtain for every frequency a first form of distance measure, thus $$F_{1m}(e^{j\omega})\cdot F^*_{2m}(e^{j\omega})$$

where (•)*represents the complex conjugate. This may be used as a difference measure for frequency ω for microphone m. The combined frequency difference measure for all microphones may be generated as the sum of these, i.e.

$$S(\omega) = \langle f^1 \mid f^2 \rangle = \sum_{m=1}^{M} F_{1m}(e^{j\omega}) \cdot F^*_{2m}(e^{j\omega})$$

If the two filters are not related, i.e. the adapted state of the filters and thus the beams formed are very different, this sum is expected to be close to zero, and thus the frequency difference measure is close to zero. However, if the filter coefficients are similar, a large positive value is obtained. If the filter coefficients have the opposite sign, then a large negative value is obtained. Thus, the generated frequency difference measure is indicative of the similarity of the beamform filters for this frequency.

The multiplication of the two complex coefficients (including the conjugation) results in a complex value and in many embodiments, it may be desirable to convert this into a scalar value.

In particular, in many embodiments, the frequency difference measure for a given frequency is determined in response to a real part of the combination of frequency difference measures for the different microphones for that frequency.

Specifically, the combined frequency difference measure may be determined as:

$$S(\omega) = \mathrm{Re}(\langle f^1 \mid f^2 \rangle) = \mathrm{Re}\left(\sum_{m=1}^{M} F_{1m}(e^{j\omega}) \cdot F^*_{2m}(e^{j\omega})\right)$$

In this measure, the similarity measure based on Re(S) results in the maximum value being attained when the filter coefficients are the same whereas the minimum value is attained when the filter coefficients are the same but have opposite signs.

Another approach is to determine the combined frequency difference measure for a given frequency in response to a norm of the combination of the frequency difference measures for the microphones. The norm may typically advantageously be an L1 or L2 norm. E.g:

$$S(\omega) = |\langle f^1 \mid f^2 \rangle| = \left|\sum_{m=1}^{M} F_{1m}(e^{j\omega}) \cdot F^*_{2m}(e^{j\omega})\right|$$

In some embodiments, the combined frequency difference measure for all microphones of the microphone array 301 is thus determined as the amplitude or absolute value of the sum of the complex valued frequency difference measures for the individual microphones.

In many embodiments, it may be advantageous to normalize the difference measures. For example, it may be advantageous to normalize the difference measure such that it falls in the interval of [0;1].

In some embodiments, the difference measures described above may be normalized by being determined in response to the sum of a monotonic function of a norm of the sum of the frequency domain coefficients for the first beamformer 303 and a monotonic function of a norm for the sum of the frequency domain coefficients for the second beamformer 305, where the sums are over the microphones. The norm may advantageously be an L2 norm and the monotonic function may advantageously be a square function.

Thus, the difference measures may be normalized relative to the following value:

$$N_1(f^1,f^2)=\|f^1\|_2^2+\|f^2\|_2^2$$

Combined with the first approach described above, this results in combined frequency difference measures given as:

$$s_5(f^1, f^2) = \frac{1}{2} + \frac{\mathrm{Re}(\langle f^1 \mid f^2 \rangle)}{\|f^1\|_2^2 + \|f^2\|_2^2}$$

where the offset of ½ is introduced such that for $f^1=f^2$ the frequency difference measure has a value of one and for $f^1=-f^2$ the frequency difference measure has a value of zero. Thus, a difference measure between 0 and 1 is generated where an increasing value is indicative of a reducing difference. It will be appreciated that if an increasing value is desired for an increasing difference, this can simply be achieved by determining:

$$s_5'(f^1, f^2) = 1 - s_5(f^1, f^2) = \frac{1}{2} - \frac{\mathrm{Re}(\langle f^1 \mid f^2 \rangle)}{\|f^1\|_2^2 + \|f^2\|_2^2}$$

Similarly, for the second approach, the following frequency difference measure can be determined:

$$s_6(f^1, f^2) = \frac{2|\langle f^1 \mid f^2 \rangle|}{\|f^1\|_2^2 + \|f^2\|_2^2}$$

again resulting in a frequency difference measure falling in the interval of [0;1].

As another example, the normalization may in some embodiments be based on a multiplication of the norms, and specifically the L2 norms, of the individual summations of the frequency domain coefficients:

$$N_2(f^1, f^2) = \|f^1\|_2 \cdot \|f^2\|_2$$

This may in particular in many applications provide very advantageous performance for the last example of a difference measure (i.e. based on the L1 norm for the coefficients). In particular, the following frequency difference measure may be used:

$$s_7(f^1, f^2) = \frac{|\langle f^1 \mid f^2 \rangle|}{\|f^1\|_2 \cdot \|f^2\|_2}$$

The specific frequency difference measures may accordingly be determined as:

$$s_5(f^1, f^2) = \frac{1}{2} + \frac{\mathrm{Re}(\langle f^1 \mid f^2 \rangle)}{\|f^1\|_2^2 + \|f^2\|_2^2}$$

$$s_6(f^1, f^2) = \frac{2|\langle f^1 \mid f^2 \rangle|}{\|f^1\|_2^2 + \|f^2\|_2^2}$$

$$s_7(f^1, f^2) = \frac{|\langle f^1 \mid f^2 \rangle|}{\|f^1\|_2 \cdot \|f^2\|_2}$$

where $\langle a|b \rangle = ((a)^H b)^*$ is an inner product and $\|a\|_2 = \sqrt{\langle a|a \rangle}$ is the $L^2$ norm.

The difference processor 309 may then generate the difference measure from the frequency difference measures by combining these into a single difference measure indicative of how similar the beams of the first beamformer 303 and the second beamformer 305 are.

Specifically, the difference measure may be determined as a frequency selective weighted sum of the frequency difference measures. The frequency selective approach may specifically be useful to apply a suitable frequency window allowing e.g. emphasis to be put on specific frequency ranges, such as for example on the audio range or the main speech frequency intervals. E.g., a (weighted) averaging may be applied to generate a robust wide band difference measure.

Specifically, the difference measure may be determined as:

$$S(f^1, f^2) = \int_{\omega=0}^{2\pi} (e^{j\omega}) s(f^1, f^2, e^{j\omega}) d\omega$$

where $w(e^{j\omega})$ is a suitable weighting function.

As an example, the weight function $w(e^{j\omega})$ may be designed to take into account that speech is mainly active in certain frequency bands and/or that microphone arrays tend to have low directionality for relatively low frequencies.

It will be appreciated that whereas the above equations are presented in the continuous frequency domain, they can readily be translated into the discrete frequency domain.

For example, discrete time domain filters may first be transformed into discrete frequency domain filters by applying a discrete Fourier transform, i.e., for 0<k<K, we can calculate:

$$F_m^j[k] = \sum_{n=0}^{N_f - 1} f_m^j[n] e^{-j2\pi \frac{n}{N_f} k}$$

where $f_m^j[n]$ represents the discrete time filter response of the j'th beamformer for the m'th microphone, $N_f$ is the length of the time domain filters, $F_m^j[k]$ represents the discrete frequency domain filter of the j'th beamformer for the m'th microphone, and K is the length of the frequency domain beamform filters, typically chosen as $K=2N_f$ (often the same number as time domain coefficients although this is not necessarily the case. For example, for a number of time domain coefficients different than $2^N$, zero stuffing may be used to facilitate frequency domain conversion (e.g. using an FFT)).

The discrete frequency domain counterparts of the vectors $f^1$ and $f^2$ are the vectors $F^1[k]$ and $F^2[k]$, which are obtained by collecting the frequency domain filter coefficients for frequency index k for all microphones into a vector.

Subsequently, calculation of e.g. the similarity measure $s_7(F^1, F^2)[k]$ may then be performed in the following way:

$$S_7(F^1, F^2)[k] = \frac{|\langle F^1[k], F^2[k] \rangle|}{\|F^1[k]\|_2 \cdot \|F^2[k]\|_2}$$

with $$\langle F^1[k], F^2[k] \rangle = \sum_{m=1}^{M} F_m^1[k] \cdot (F_m^2)*[k]$$

$$\|F^1[k]\|_2 = \sqrt{\left| \sum_{m=1}^{M} F_m^1[k] \cdot (F_m^1)*[k] \right|}$$

$$\|F^2[k]\|_2 = \sqrt{\left| \sum_{m=1}^{M} F_m^2[k] \cdot (F_m^2)*[k] \right|}$$

where $(\bullet)^*$ represents complex conjugation.

Finally, the wide band similarity measure $S_7(F^1, F^2)$ may, based on weighting function w [k], be calculated as follows:

$$S_7(F^1, F^2) = \sum_{K=0}^{K-1} w[k] s_7(F^1, F^2)[k]$$

Choosing the weighting function as w[k]=1/K leads to a wide band similarity measure that is bounded between zero and one and that weights all frequencies equally.

Alternative weighting functions can focus on a specific frequency range (e.g. due to it being likely to contain speech). In such a case a weighting function that leads to a similarity measure bounded between zero and one can then e.g. be chosen as:

$$w[k] = \begin{cases} \frac{1}{|k_2 - k_1|} & \text{for } k_1 \le k < k_2 \\ 0 & \text{elsewhere} \end{cases}$$

where $k_1$ and $k_2$ are frequency indices corresponding to the boundaries of the desired frequency range.

The derived difference measure provides particularly efficient performance with different characteristics that may be desirable in different embodiments. In particular, the determined values may be sensitive to different properties of the beam difference, and depending on the preferences of the individual embodiment, different measures may be preferred.

Indeed, difference/similarity measure $s_5(f^1, f^2)$ can be considered to measure phase, attenuation, and direction differences between the beamformers, while $s_6(f^1, f^2)$ only takes gain and direction differences into account. Finally, difference measure $s_7(f^1, f^2)$ takes only direction differences into account and ignores phase and attenuation differences.

These differences relate to the structure of the beamformers. Specifically, suppose that the filter coefficients of a beamformer share a common (frequency dependent) factor over all microphones, which we indicate as $A(e^{j\omega})$. In this case, the beamformer filter coefficients can be decomposed as follows:

$$F_{11}(e^{j\omega})=A(e^{j\omega})\hat{F}_{11}(e^{j\omega}) \ldots F_{1m}(e^{j\omega})=A(e^{j\omega})\hat{F}_{1m}(e^{j\omega})$$

In short-hand notation we have $f^1=A(e^{j\omega})\hat{f}^1$. Next we consider two versions of the common factor $A(e^{j\omega})$.

In the first case, we assume the common factor consists of only a (frequency dependent) phase shift, i.e., $A(e^{j\omega})=e^{j\omega\Phi_\omega}$ also known as an all-pass filter. In the second case, we assume that the common factor has an arbitrary gain and phase shift per frequency. The three presented similarity measures deal with these common factors differently.

- $s_5(f^1, f^2)$ is sensitive to the common amplitude and phase differences between beamformers.
- $s_6(f^1, f^2)$ is sensitive to the common amplitude differences between the beamformers
- $s_7(f^1, f^2)$ is insensitive to the common factor $A(e^{j\omega})$ This can be seen from the following examples:

Example 1

In this example, we consider a scenario with $f^1=A(e^{j\omega})f^2$, with $A(e^{j\omega})=e^{j\omega\Phi_\omega}$ being an arbitrary phase per frequency, i.e., an all-pass filter.

This results in the following results for the similarity measures:

$$s_5(f^1, f^2) = \frac{1}{2} + \frac{\mathrm{Re}(\langle A(e^{j\omega})f^2 \mid f^2\rangle)}{|A(e^{j\omega})|^2 \cdot \|f^2\|_2^2 + \|f^2\|_2^2} = \frac{1}{2} + \frac{\mathrm{Re}\left(A(e^{j\omega}) \cdot \|f^2\|_2^2\right)}{2\|f^2\|_2^2} = \frac{1 + \mathrm{Re}(A(e^{j\omega}))}{2}$$

$$s_6(f^1, f^2) = \frac{2|\langle A(e^{j\omega})f^2 \mid f^2\rangle|}{|A(e^{j\omega})|^2 \cdot \|f^2\|_2^2 + \|f^2\|_2^2} = \frac{2|\langle f^2 \mid f^2\rangle|}{\|f^2\|_2^2 + \|f^2\|_2^2} = 1$$

-continued $$s_7(f^1, f^2) = \frac{|\langle A(e^{j\omega})f^2 \mid f^2\rangle|}{|A(e^{j\omega})| \cdot \|f^2\|_2 \cdot \|f^2\|_2} = \frac{|\langle f^2 \mid f^2\rangle|}{\|f^2\|_2 \cdot \|f^2\|_2} = 1$$

Example 2

In this example, we consider a scenario with $f^1=B(e^{j\omega})f^2$, with $B(e^{j\omega})$ in an arbitrary gain and phase per frequency. This results in the following results for the similarity measures:

$$s_5(f^1, f^2) = \frac{1}{2} + \frac{\mathrm{Re}(\langle B(e^{j\omega})f^2 \mid f^2\rangle)}{|B(e^{j\omega})|^2 \cdot \|f^2\|_2^2 + \|f^2\|_2^2} = \frac{1}{2} + \frac{\mathrm{Re}\left(B(e^{j\omega}) \cdot \|f^2\|_2^2\right)}{(1 + |B(e^{j\omega})|^2) \cdot \|f^2\|_2^2} = \frac{1}{2} + \frac{\mathrm{Re}(B(e^{j\omega}))}{1 + |B(e^{j\omega})|^2}$$

$$s_6(f^1, f^2) = \frac{2|\langle B(e^{j\omega})f^2 \mid f^2\rangle|}{|B(e^{j\omega})|^2 \cdot \|f^2\|_2^2 + \|f^2\|_2^2} = \frac{2|B(e^{j\omega})| \cdot |\langle f^2 \mid f^2\rangle|}{|B(e^{j\omega})|^2 \cdot \|f^2\|_2^2 + \|f^2\|_2^2} = \frac{2|B(e^{j\omega})|}{1 + |B(e^{j\omega})|^2}$$

$$s_7(f^1, f^2) = \frac{|\langle B(e^{j\omega})f^2 \mid f^2\rangle|}{|B(e^{j\omega})| \cdot \|f^2\|_2 \cdot \|f^2\|_2} = \frac{|\langle f^2 \mid f^2\rangle|}{\|f^2\|_2 \cdot \|f^2\|_2} = 1$$

In many practical embodiments, there may be a common gain and phase difference between the beamformers, and accordingly difference measure $s_7(f^1,f^2)$ may in many embodiments provide a particularly attractive measure.

In the following an audio capturing apparatus will be described in which the generated difference measure interworks with the other described elements to provide a particularly advantageous audio capturing system. In particular, the approach is highly suitable for capturing audio sources in noisy and reverberant environments. It provides particularly advantageous performance for applications wherein a desired audio source may be outside the reverberation radius and the audio captured by the microphones may be dominated by diffuse noise and late reflections or reverberations.

Figure 5:
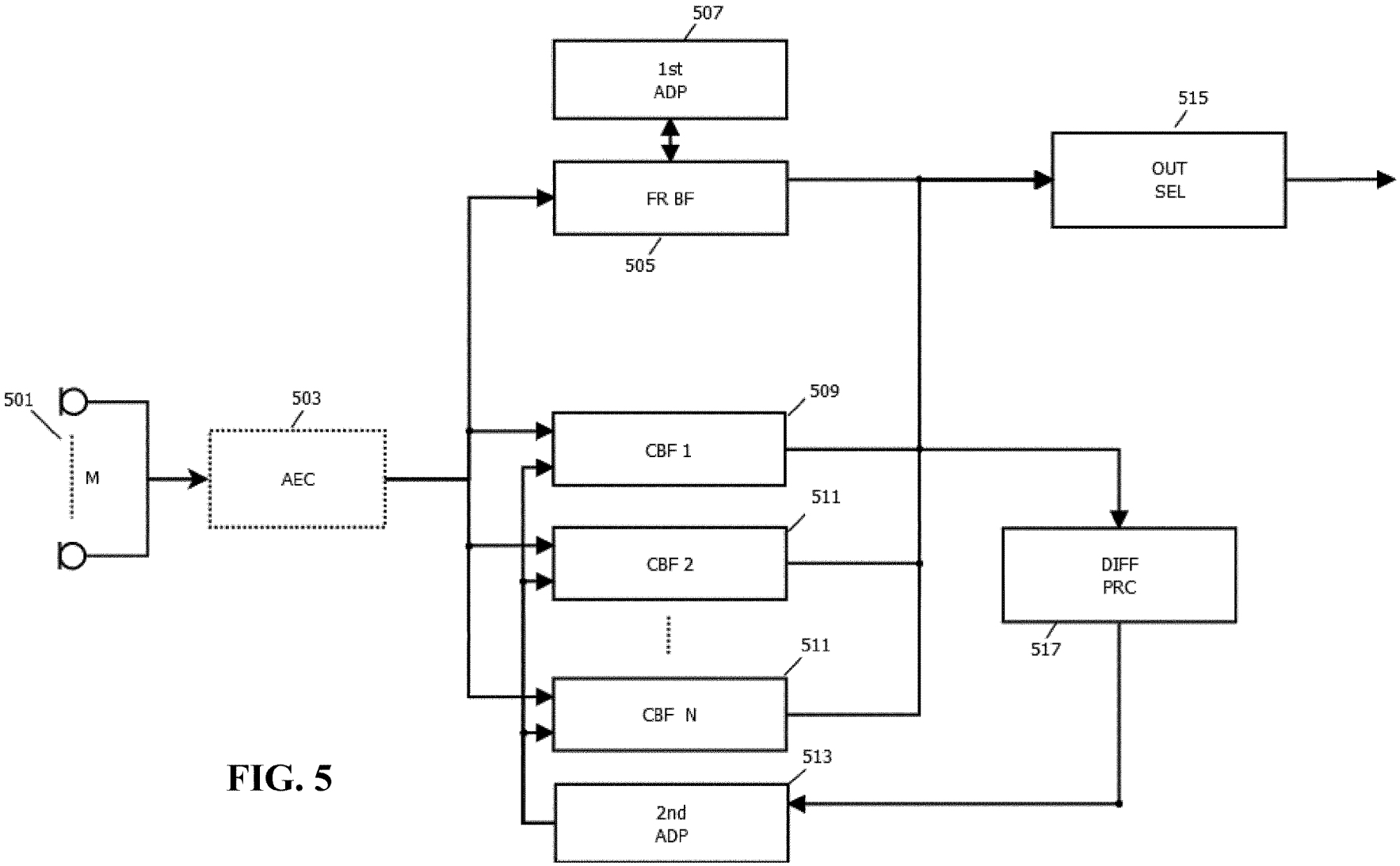
FIG. 5 illustrates an example of elements of an audio capturing apparatus in accordance with some embodiments of the invention.

FIG. 5 illustrates an example of elements of such an audio capturing apparatus in accordance with some embodiments of the invention. The elements and approach of the system of FIG. 3 may correspond to the system of FIG. 5 as set out in the following.

The audio capturing apparatus comprises a microphone array 501 which may directly correspond to that of FIG. 3. In the example, the microphone array 501 is coupled to an optional echo canceller 503 which may cancel the echoes that originate from acoustic sources (for which a reference signal is available) that are linearly related to the echoes in the microphone signal(s). This source can for example be a loudspeaker. An adaptive filter can be applied with the reference signal as input, and with the output being subtracted from the microphone signal to create an echo compensated signal. This can be repeated for each individual microphone.

It will be appreciated that the echo canceller 503 is optional and simply may be omitted in many embodiments.

The microphone array 501 is coupled to a first beamformer 505, typically either directly or via the echo canceller 503 (as well as possibly via amplifiers, digital to analog converters etc. as will be well known to the person skilled in the art). The first beamformer 505 may directly correspond to the first beamformer 303 of FIG. 3.

The first beamformer 505 is arranged to combine the signals from the microphone array 501 such that an effective directional audio sensitivity of the microphone array 501 is generated. The first beamformer 505 thus generates an output signal, referred to as the first beamformed audio output, which corresponds to a selective capturing of audio in the environment. The first beamformer 505 is an adaptive beamformer and the directivity can be controlled by setting parameters, referred to as first beamform parameters, of the beamform operation of the first beamformer 505.

The first beamformer 505 is coupled to a first adapter 507 which is arranged to adapt the first beamform parameters. Thus, the first adapter 507 is arranged to adapt the parameters of the first beamformer 505 such that the beam can be steered.

In addition, the audio capturing apparatus comprises a plurality of constrained beamformers 509, 511 each of which is arranged to combine the signals from the microphone array 501 such that an effective directional audio sensitivity of the microphone array 501 is generated. Each of the constrained beamformers 509, 511 is thus arranged to generate an audio output, referred to as the constrained beamformed audio output, which corresponds to a selective capturing of audio in the environment. Similarly, to the first beamformer 505, the constrained beamformers 509, 511 are adaptive beamformers where the directivity of each constrained beamformer 509, 511 can be controlled by setting parameters, referred to as constrained beamform parameters, of the constrained beamformers 509, 511.

The audio capturing apparatus accordingly comprises a second adapter 513 which is arranged to adapt the constrained beamform parameters of the plurality of constrained beamformers thereby adapting the beams formed by these.

The second beamformer 305 of FIG. 3 may directly correspond to the first constrained beamformer 509 of FIG. 5. It will also be appreciated that the remaining constrained beamformers 511 may correspond to the first beamformer 303 and could be considered instantiations of this.

Both the first beamformer 505 and the constrained beamformers 509, 511 are accordingly adaptive beamformers for which the actual beam formed can be dynamically adapted. Specifically, the beamformers 505, 509, 511 are filter-and-combine (or specifically in most embodiments filter-and-sum) beamformers. A beamform filter may be applied to each of the microphone signals and the filtered outputs may be combined, typically by simply being added together.

It will be appreciated that the comments provided with respect to the first beamformer 303 and second beamformer 305 (e.g. with respect to the beamform filters) apply equivalently to the beamformers 505, 509, 511 of FIG. 5.

In many embodiments, the structure and implementation of the first beamformer 505 and the constrained beamformers 509, 511 may be the same, e.g. the beamform filters may have identical FIR filter structures with the same number of coefficients etc.

However, the operation and parameters of the first beamformer 505 and the constrained beamformers 509, 511 will be different, and in particular the constrained beamformers 509, 511 are constrained in ways the first beamformer 505 is not. Specifically, the adaptation of the constrained beamformers 509, 511 will be different than the adaptation of the first beamformer 505 and will specifically be subject to some constraints.

Specifically, the constrained beamformers 509, 511 are subject to the constraint that the adaptation (updating of beamform filter parameters) is constrained to situations when a criterion is met whereas the first beamformer 505 will be allowed to adapt even when such a criterion is not met. Indeed, in many embodiments, the first adapter 507 may be allowed to always adapt the beamform filter with this not being constrained by any properties of the audio captured by the first beamformer 505 (or of any of the constrained beamformers 509, 511).

The criterion for adapting the constrained beamformers 509, 511 will be described in more detail later.

In many embodiments, the adaptation rate for the first beamformer 505 is higher than for the constrained beamformers 509, 511. Thus, in many embodiments, the first adapter 507 may be arranged to adapt faster to variations than the second adapter 513, and thus the first beamformer 505 may be updated faster than the constrained beamformers 509, 511. This may for example be achieved by the low pass filtering of a value being maximized or minimized (e.g. the signal level of the output signal or the magnitude of an error signal) having a higher cut-off frequency for the first beamformer 505 than for the constrained beamformers 509, 511. As another example, a maximum change per update of the beamform parameters (specifically the beamform filter coefficients) may be higher for the first beamformer 505 than for the constrained beamformers 509, 511.

Accordingly, in the system, a plurality of focused (adaptation constrained) beamformers that adapt slowly and only when a specific criterion is met is supplemented by a free running faster adapting beamformer that is not subject to this constraint. The slower and focused beamformers will typically provide a slower but more accurate and reliable adaptation to the specific audio environment than the free running beamformer which however will typically be able to quickly adapt over a larger parameter interval.

In the system of FIG. 5, these beamformers are used synergistically together to provide improved performance as will be described in more detail later.

The first beamformer 505 and the constrained beamformers 509, 511 are coupled to an output processor 515 which receives the beamformed audio output signals from the beamformers 505, 509, 511. The exact output generated from the audio capturing apparatus will depend on the specific preferences and requirements of the individual embodiment. Indeed, in some embodiments, the output from the audio capturing apparatus may simply consist in the audio output signals from the beamformers 505, 509, 511.

In many embodiments, the output signal from the output processor 515 is generated as a combination of the audio output signals from the beamformers 505, 509, 511. Indeed, in some embodiments, a simple selection combining may be performed, e.g. selecting the audio output signals for which the signal to noise ratio, or simply the signal level, is the highest.

Thus, the output selection and post-processing of the output processor 515 may be application specific and/or different in different implementations/embodiments. For example, all possible focused beam outputs can be provided, a selection can be made based on a criterion defined by the user (e.g. the strongest speaker is selected), etc.

For a voice control application, for example, all outputs may be forwarded to a voice trigger recognizer which is arranged to detect a specific word or phrase to initialize voice control. In such an example, the audio output signal in which the trigger word or phrase is detected may following the trigger phrase be used by a voice recognizer to detect specific commands.

For communication applications, it may for example be advantageous to select the audio output signal that is strongest and e.g. for which the presence of a specific point audio source has been found.

In some embodiments, post-processing such as the noise suppression of FIG. 1, may be applied to the output of the audio capturing apparatus (e.g. by the output processor 515). This may improve performance for e.g. voice communication. In such post-processing, non-linear operations may be included although it may e.g. for some speech recognizers be more advantageous to limit the processing to only include linear processing.

In the system of FIG. 5, a particularly advantageous approach is taken to capture audio based on the synergistic interworking and interrelation between the first beamformer 505 and the constrained beamformers 509, 511.

For this purpose, the audio capturing apparatus comprises a difference processor 517 which is arranged to determine a difference measure between one or more of the constrained beamformers 509, 511 and the first beamformer 505. The difference measure is indicative of a difference between the beams formed by respectively the first beamformer 505 and the constrained beamformer 509, 511. Thus, the difference measure for a first constrained beamformer 509 may indicate the difference between the beams that are formed by the first beamformer 505 and by the first constrained beamformer 509. In this way, the difference measure may be indicative of how closely the two beamformers 505, 509 are adapted to the same audio source.

The difference processor 517 corresponds directly to the difference processor 309 of FIG. 3 and the approach described with respect to this are directly applicable to the difference processor 517 of FIG. 5. Thus, the system of FIG. 5 uses the described approach for determining a difference measure between beams of the first beamformer 505 and one of the constrained beamformers 509, 511 in response to a comparison of the adaptive impulse responses of the beamform filters of the first beamformer 505 to the adaptive impulse responses of the beamform filters of the constrained beamformer 509, 511. It will be appreciated that in many embodiments, a difference measure may be determined for each constrained beamformer 509, 511.

Thus, in the system of FIG. 5, a difference measure is generated to reflect a difference between the beamform parameters of the first beamformer 505 and the first constrained beamformer 509 and/or a difference between the beamformed audio outputs of these.

It will be appreciated that generating, determining, and/or using a difference measure is directly equivalent to generating, determining, and/or using a similarity measure. Indeed, one may typically be considered to be a monotonically decreasing function of the other, and thus a difference measure is also a similarity measure (and vice versa) with typically one simply indicating increasing differences by increasing values and the other doing this by decreasing values.

The difference processor 517 is coupled to the second adapter 513 and provides the difference measure to this. The second adapter 513 is arranged to adapt the constrained beamformers 509, 511 in response to the difference measure. Specifically, the second adapter 513 is arranged to adapt constrained beamform parameters only for constrained beamformers for which a difference measure has been determined that meets a similarity criterion. Thus, if no difference measure has been determined for a given constrained beamformers 509, 511, or if the determined difference measure for the given constrained beamformer 509, 511 indicates that the beams of the first beamformer 505 and the given constrained beamformer 509, 511 are not sufficiently similar, then no adaptation is performed.

Thus, in the audio capturing apparatus of FIG. 5, the constrained beamformers 509, 511 are constrained in the adaptation of the beams. Specifically, they are constrained to only adapt if the current beam formed by the constrained beamformer 509, 511 is close to the beam that the free running first beamformer 505 is forming, i.e. the individual constrained beamformer 509, 511 is only adapted if the first beamformer 505 is currently adapted to be sufficiently close to the individual constrained beamformer 509, 511.

The result of this is that the adaptation of the constrained beamformers 509, 511 are controlled by the operation of the first beamformer 505 such that effectively the beam formed by the first beamformer 505 controls which of the constrained beamformers 509, 511 is (are) optimized/adapted. This approach may specifically result in the constrained beamformers 509, 511 tending to be adapted only when a desired audio source is close to the current adaptation of the constrained beamformer 509, 511.

The approach of requiring similarity between the beams in order to allow adaptation has in practice been found to result in a substantially improved performance when the desired audio source, the desired speaker in the present case, is outside the reverberation radius. Indeed, it has been found to provide highly desirable performance for, in particular, weak audio sources in reverberant environments with a non-dominant direct path audio component.

In many embodiments, the constraint of the adaptation may be subject to further requirements.

For example, in many embodiments, the adaptation may be a requirement that a signal to noise ratio for the beamformed audio output exceeds a threshold. Thus, the adaptation for the individual constrained beamformer 509, 511 may be restricted to scenarios wherein this is sufficiently adapted and the signal on basis of which the adaptation is based reflects the desired audio signal.

It will be appreciated that different approaches for determining the signal to noise ratio may be used in different embodiments. For example, the noise floor of the microphone signals can be determined by tracking the minimum of a smoothed power estimate and for each frame or time interval the instantaneous power is compared with this minimum. As another example, the noise floor of the output of the beamformer may be determined and compared to the instantaneous output power of the beamformed output.

In some embodiments, the adaptation of a constrained beamformer 509, 511 is restricted to when a speech component has been detected in the output of the constrained beamformer 509, 511. This will provide improved performance for speech capture applications. It will be appreciated that any suitable algorithm or approach for detecting speech in an audio signal may be used.

It will be appreciated that the system of FIGS. 3-7 typically operate using a frame or block processing. Thus, consecutive time intervals or frames are defined and the described processing may be performed within each time interval. For example, the microphone signals may be divided into processing time intervals, and for each processing time interval the beamformers 505, 509, 511 may generate a beamformed audio output signal for the time interval, determine a difference measure, select a constrained beamformers 509, 511, and update/adapt this constrained beamformer 509, 511 etc. Processing time intervals may in many embodiments advantageously have a duration between 5 msec and 50 msec.

It will be appreciated that in some embodiments, different processing time intervals may be used for different aspects and functions of the audio capturing apparatus. For example, the difference measure and selection of a constrained beamformer 509, 511 for adaptation may be performed at a lower frequency than e.g. the processing time interval for beamforming.

Figure 6:
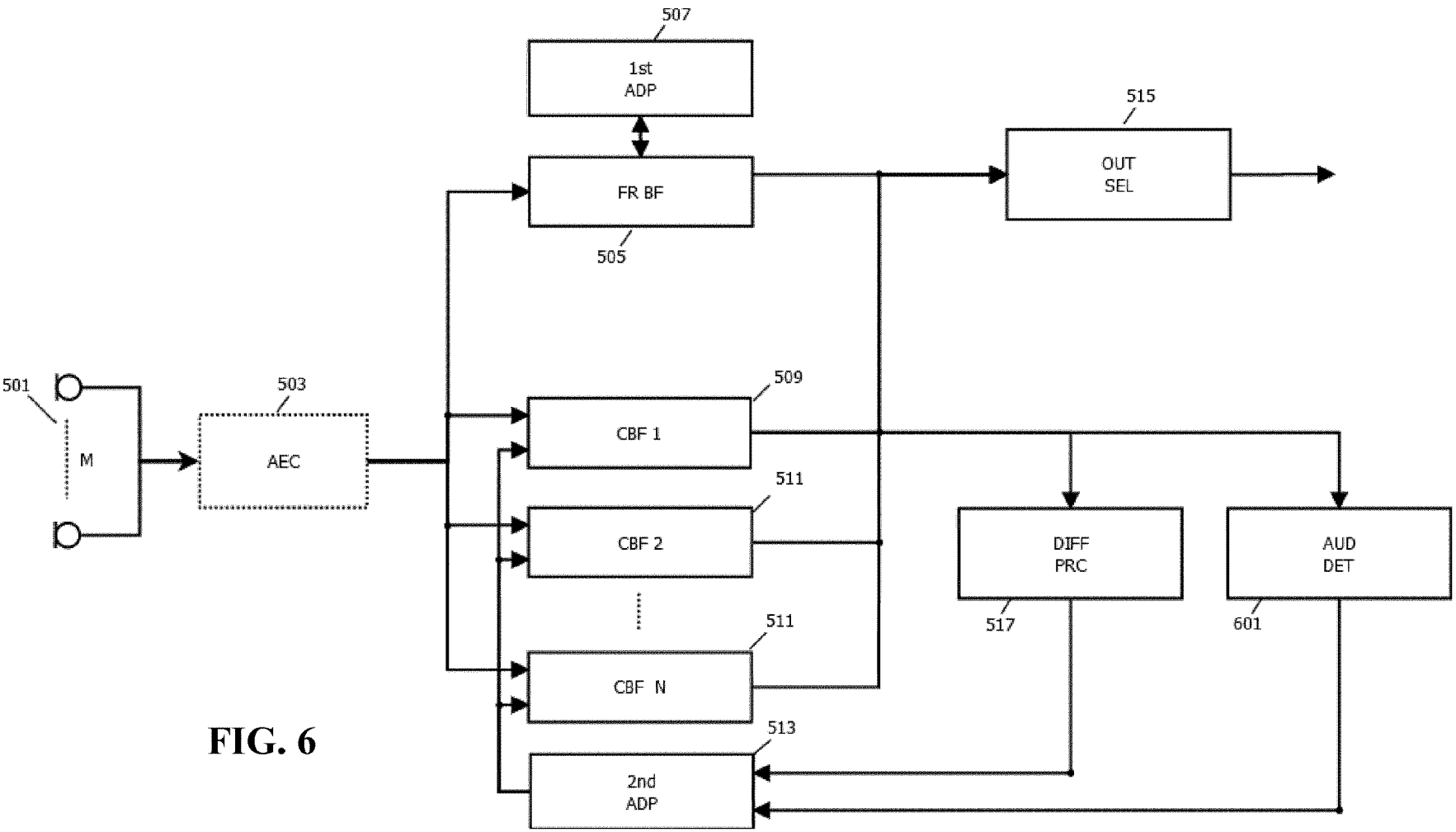
FIG. 6 illustrates an example of elements of an audio capturing apparatus in accordance with some embodiments of the invention.

In many embodiments, the adaptation may be in dependence on the detection of point audio sources in the beamformed audio outputs. Accordingly, in many embodiments, the audio capturing apparatus may further comprise an audio source detector 601 as illustrated in FIG. 6.

The audio source detector 601 may specifically in many embodiments be arranged to detect point audio sources in the second beamformed audio outputs and accordingly the audio source detector 601 is coupled to the constrained beamformers 509, 511 and it receives the beamformed audio outputs from these.

An audio point source in acoustics is a sound that originates from a point in space. It will be appreciated that the audio source detector 601 may use different algorithms or criteria for estimating (detecting) whether a point audio source is present in the beamformed audio output from a given constrained beamformer 509, 511 and that the skilled person will be aware of various such approaches.

An approach may specifically be based on identifying characteristics of a single or dominant point source captured by the microphones of the microphone array 501. A single or dominant point source can e.g. be detected by looking at the correlation between the signals on the microphones. If there is a high correlation, then a dominant point source is considered to be present. If the correlation is low, then it is considered that there is not a dominant point source but that the captured signals originate from many uncorrelated sources. Thus, in many embodiments, a point audio source may be considered to be a spatially correlated audio source, where the spatial correlation is reflected by the correlation of the microphone signals.

In the present case, the correlation is determined after the filtering by the beamform filters. Specifically, a correlation of the output of the beamform filters of the constrained beamformers 509, 511 may be determined, and if this exceeds a given threshold, a point audio source may be considered to have been detected.

In other embodiments, a point source may be detected by evaluating the content of the beamformed audio outputs. For example, the audio source detector 601 may analyze the beamformed audio outputs, and if a speech component of sufficient strength is detected in a beamformed audio output this may be considered to correspond to a point audio source, and thus the detection of a strong speech component may be considered to be a detection of a point audio source.

The detection result is passed from the audio source detector 601 to the second adapter 513 which is arranged to adapt the adaptation in response to this. Specifically, the second adapter 513 may be arranged to adapt only constrained beamformers 509, 511 for which the audio source detector 601 indicates that a point audio source has been detected.

Thus, the audio capturing apparatus is arranged to constrain the adaptation of the constrained beamformers 509, 511 such that only constrained beamformers 509, 511 are adapted in which a point audio source is present in the formed beam, and the formed beam is close to that formed by the first beamformer 505. Thus, the adaptation is typically restricted to constrained beamformers 509, 511 which are already close to a (desired) point audio source. The approach allows for a very robust and accurate beamforming that performs exceedingly well in environments where the desired audio source may be outside a reverberation radius. Further, by operating and selectively updating a plurality of constrained beamformers 509, 511, this robustness and accuracy may be supplemented by a relatively fast reaction time allowing quick adaptation of the system as a whole to fast moving or newly occurring sound sources.

In many embodiments, the audio capturing apparatus may be arranged to only adapt one constrained beamformer 509, 511 at a time. Thus, the second adapter 513 may in each adaptation time interval select one of the constrained beamformers 509, 511 and adapt only this by updating the beamform parameters.

The selection of a single constrained beamformers 509, 511 will typically occur automatically when selecting a constrained beamformer 509, 511 for adaptation only if the current beam formed is close to that formed by the first beamformer 505 and if a point audio source is detected in the beam.

However, in some embodiments, it may be possible for a plurality of constrained beamformers 509, 511 to simultaneously meet the criteria. For example, if a point audio source is positioned close to regions covered by two different constrained beamformers 509, 511 (or e.g. it is in an overlapping area of the regions), the point audio source may be detected in both beams and these may both have been adapted to be close to each other by both being adapted towards the point audio source.

Thus, in such embodiments, the second adapter 513 may select one of the constrained beamformers 509, 511 meeting the two criteria and only adapt this one. This will reduce the risk that two beams are adapted towards the same point audio source and thus reduce the risk of the operations of these interfering with each other.

Indeed, adapting the constrained beamformers 509, 511 under the constraint that the corresponding difference measure must be sufficiently low and selecting only a single constrained beamformers 509, 511 for adaptation (e.g. in each processing time interval/frame) will result in the adaptation being differentiated between the different constrained beamformers 509, 511. This will tend to result in the constrained beamformers 509, 511 being adapted to cover different regions with the closest constrained beamformer 509, 511 automatically being selected to adapt/follow the audio source detected by the first beamformer 505. However, in contrast to e.g. the approach of FIG. 2, the regions are not fixed and predetermined but rather are dynamically and automatically formed.

It should also be noted that the regions may be dependent on the beamforming for a plurality of paths and are typically not limited to angular direction of arrival regions. For example, regions may be differentiated based on the distance to the microphone array. Thus, the term region may be considered to refer to positions in space at which an audio source will result in adaptation that meets similarity requirement for the difference measure. It thus includes consideration of not only the direct path but also e.g. reflections if these are considered in the beamform parameters and in particular are determined based on both spatial and temporal aspect (and specifically depend on the full impulse responses of the beamform filters).

The selection of a single constrained beamformer 509, 511 may specifically be in response to a captured audio level. For example, the audio source detector 601 may determine the audio level of each of the beamformed audio outputs from the constrained beamformers 509, 511 that meet the criteria, and it may select the constrained beamformer 509, 511 resulting in the highest level. In some embodiments, the audio source detector 601 may select the constrained beamformer 509, 511 for which a point audio source detected in the beamformed audio output has the highest value. For example, the audio source detector 601 may detect a speech component in the beamformed audio outputs from two constrained beamformers 509, 511 and proceed to select the one having the highest level of the speech component.

In the approach, a very selective adaptation of the constrained beamformers 509, 511 is thus performed leading to these only adapting in specific circumstances. This provides a very robust beamforming by the constrained beamformers 509, 511 resulting in improved capture of a desired audio source. However, in many scenarios, the constraints in the beamforming may also result in a slower adaptability and indeed may in many situations result in new audio sources (e.g. new speakers) not being detected or only being very slowly adapted to.

Figure 7:
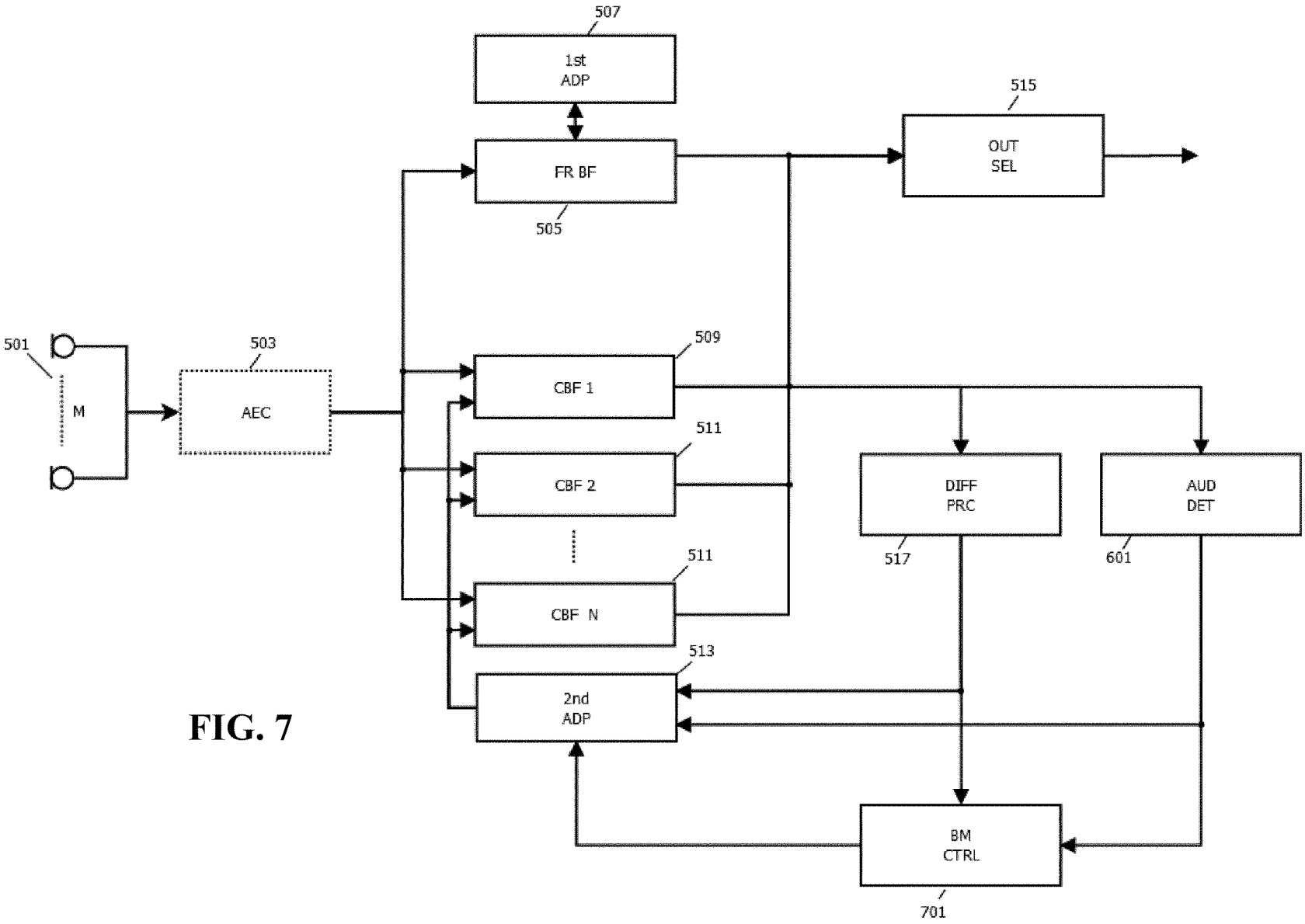
FIG. 7 illustrates an example of elements of an audio capturing apparatus in accordance with some embodiments of the invention.

FIG. 7 illustrates the audio capturing apparatus of FIG. 6 but with the addition of a beamformer controller 701 which is coupled to the second adapter 513 and the audio source detector 601. The beamformer controller 701 is arranged to initialize a constrained beamformer 509, 511 in certain situations. Specifically, the beamformer controller 701 can initialize a constrained beamformer 509, 511 in response to the first beamformer 505, and specifically can initialize one of the constrained beamformers 509, 511 to form a beam corresponding to that of the first beamformer 505.

The beamformer controller 701 specifically sets the beamform parameters of one of the constrained beamformers 509, 511 in response to the beamform parameters of the first beamformer 505, henceforth referred to as the first beamform parameters. In some embodiments, the filters of the constrained beamformers 509, 511 and the first beamformer 505 may be identical, e.g. they may have the same architecture. As a specific example, both the filters of the constrained beamformers 509, 511 and the first beamformer 505 may be FIR filters with the same length (i.e. a given number of coefficients), and the current adapted coefficient values from filters of the first beamformer 505 may simply be copied to the constrained beamformer 509, 511, i.e. the coefficients of the constrained beamformer 509, 511 may be set to the values of the first beamformer 505. In this way, the constrained beamformer 509, 511 will be initialized with the same beam properties as currently adapted to by the first beamformer 505.

In some embodiments, the setting of the filters of the constrained beamformer 509, 511 may be determined from the filter parameters of the first beamformer 505 but rather than use these directly they may be adapted before being applied. For example, in some embodiments, the coefficients of FIR filters may be modified to initialize the beam of the constrained beamformer 509, 511 to be broader than the beam of the first beamformer 505 (but e.g. being formed in the same direction).

The beamformer controller 701 may in many embodiments accordingly in some circumstances initialize one of the constrained beamformers 509, 511 with an initial beam corresponding to that of the first beamformer 505. The system may then proceed to treat the constrained beamformer 509, 511 as previously described, and specifically may proceed to adapt the constrained beamformer 509, 511 when it meets the previously described criteria.

The criteria for initializing a constrained beamformer 509, 511 may be different in different embodiments.

In many embodiments, the beamformer controller 701 may be arranged to initialize a constrained beamformer 509, 511 if the presence of a point audio source is detected in the first beamformed audio output but not in any constrained beamformed audio outputs.

Thus, the audio source detector 601 may determine whether a point audio source is present in any of the beamformed audio outputs from either the constrained beamformers 509, 511 or the first beamformer 505. The detection/estimation results for each beamformed audio output may be forwarded to the beamformer controller 701 which may evaluate this. If a point audio source is only detected for the first beamformer 505, but not for any of the constrained beamformers 509, 511, this may reflect a situation wherein a point audio source, such as a speaker, is present and detected by the first beamformer 505, but none of the constrained beamformers 509, 511 have detected or been adapted to the point audio source. In this case, the constrained beamformers 509, 511 may never (or only very slowly) adapt to the point audio source. Therefore, one of the constrained beamformers 509, 511 is initialized to form a beam corresponding to the point audio source. Subsequently, this beam is likely to be sufficiently close to the point audio source and it will (typically slowly but reliably) adapt to this new point audio source.

Thus, the approach may combine and provide advantageous effects of both the fast first beamformer 505 and of the reliable constrained beamformers 509, 511.

In some embodiments, the beamformer controller 701 may be arranged to initialize the constrained beamformer 509, 511 only if the difference measure for the constrained beamformer 509, 511 exceeds the threshold. Specifically, if the lowest determined difference measure for the constrained beamformers 509, 511 is below the threshold, no initialization is performed. In such a situation, it may be possible that the adaptation of constrained beamformer 509, 511 is closer to the desired situation whereas the less reliable adaptation of the first beamformer 505 is less accurate and may adapt to be closer to the first beamformer 505. Thus, in such scenarios where the difference measure is sufficiently low, it may be advantageous to allow the system to try to adapt automatically.

In some embodiments, the beamformer controller 701 may specifically be arranged to initialize a constrained beamformer 509, 511 when a point audio source is detected for both the first beamformer 505 and for one of the constrained beamformers 509, 511 but the difference measure for these fails to meet a similarity criterion. Specifically, the beamformer controller 701 may be arranged to set beamform parameters for a first constrained beamformer 509, 511 in response to the beamform parameters of the first beamformer 505 if a point audio source is detected both in the beamformed audio output from the first beamformer 505 and in the beamformed audio output from the constrained beamformer 509, 511, and the difference measure these exceeds a threshold.

Such a scenario may reflect a situation wherein the constrained beamformer 509, 511 may possibly have adapted to and captured a point audio source which however is different from the point audio source captured by the first beamformer 505. Thus, it may specifically reflect that a constrained beamformer 509, 511 may have captured the "wrong" point audio source. Accordingly, the constrained beamformer 509, 511 may be re-initialized to form a beam towards the desired point audio source.

In some embodiments, the number of constrained beamformers 509, 511 that are active may be varied. For example, the audio capturing apparatus may comprise functionality for forming a potentially relatively high number of constrained beamformers 509, 511. For example, it may implement up to, say, eight simultaneous constrained beamformers 509, 511. However, in order to reduce e.g. power consumption and computational load, not all of these may be active at the same time.

Thus, in some embodiments, an active set of constrained beamformers 509, 511 is selected from a larger pool of beamformers. This may specifically be done when a constrained beamformer 509, 511 is initialized. Thus, in the examples provided above, the initialization of a constrained beamformer 509, 511 (e.g. if no point audio source is detected in any active constrained beamformer 509, 511) may be achieved by initializing a non-active constrained beamformer 509, 511 from the pool thereby increasing the number of active constrained beamformers 509, 511.

If all constrained beamformers 509, 511 in the pool are currently active, the initialization of a constrained beamformer 509, 511 may be done by initializing a currently active constrained beamformer 509, 511. The constrained beamformer 509, 511 to be initialized may be selected in accordance with any suitable criterion. For example, the constrained beamformers 509, 511 having the largest difference measure or the lowest signal level may be selected.

In some embodiments, a constrained beamformer 509, 511 may be de-activated in response to a suitable criterion being met. For example, constrained beamformers 509, 511 may be de-activated if the difference measure increases above a given threshold.

Figure 8:
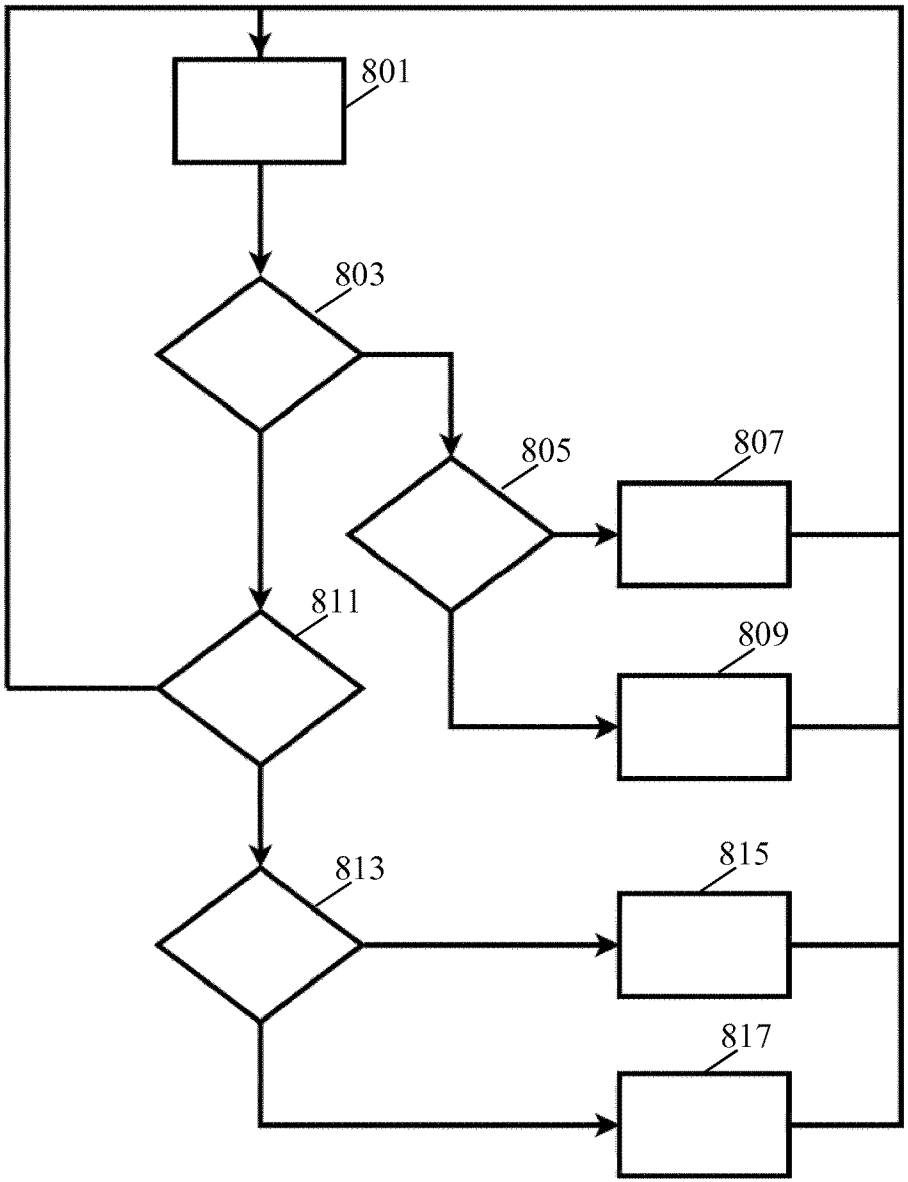
FIG. 8 illustrates an example of a flowchart for an approach of adapting constrained beamformers of an audio capturing apparatus in accordance with some embodiments of the invention.

A specific approach for controlling the adaptation and setting of the constrained beamformers 509, 511 in accordance with many of the examples described above is illustrated by the flowchart of FIG. 8.

The method starts in step 801 by the initializing the next processing time interval (e.g. waiting for the start of the next processing time interval, collecting a set of samples for the processing time interval, etc).

Step 801 is followed by step 803 wherein it is determined whether there is a point audio source detected in any of the beams of the constrained beamformers 509, 511.

If so, the method continues in step 805 wherein it is determined whether the difference measure meets a similarity criterion, and specifically whether the difference measure is below a threshold.

If so, the method continues in step 807 wherein the constrained beamformer 509, 511 in which the point audio source was detected (or which has the largest signal level in case a point audio source was detected in more than one constrained beamformer 509, 511) is adapted, i.e. the beamform (filter) parameters are updated.

If not, the method continues in step 809 wherein a constrained beamformer 509, 511 is initialized, the beamform parameters of a constrained beamformer 509, 511 is set dependent on the beamform parameters of the first beamformer 505. The constrained beamformer 509, 511 being initialized may be a new constrained beamformer 509, 511 (i.e. a beamformer from the pool of inactive beamformers) or may be an already active constrained beamformer 509, 511 for which new beamform parameters are provided.

Following either of steps 807 and 809, the method returns to step 801 and waits for the next processing time interval.

If it in step 803 is detected that no point audio source is detected in the beamformed audio output of any of the constrained beamformers 509, 511, the method proceeds to step 811 in which it is determined whether a point audio source is detected in the first beamformer 505, i.e. whether the current scenario corresponds to a point audio source being captured by the first beamformer 505 but by none of the constrained beamformers 509, 511.

If not, no point audio source has been detected at all and the method returns to step 801 to await the next processing time interval.

Otherwise, the method proceeds to step 813 wherein it is determined whether the difference measure meets a similarity criterion, and specifically whether the difference measure is below a threshold (which may be the same or may be a different threshold/criterion to that used in step 805).

If so, the method proceeds to step 815 wherein the constrained beamformer 509, 511 for which the difference measure is below the threshold is adapted (or if more than one constrained beamformer 509, 511 meets the criterion, the one with e.g. the lowest difference measure may be selected).

Otherwise, the method proceeds to step 817 wherein a constrained beamformer 509, 511 is initialized, the beamform parameters of a constrained beamformer 509, 511 is set dependent on the beamform parameters of the first beamformer 505. The constrained beamformer 509, 511 being initialized may be a new constrained beamformer 509, 511 (i.e. a beamformer from the pool of inactive beamformers) or may be an already active constrained beamformer 509, 511 for which new beamform parameters are provided.

Following either of steps 815 and 817, the method returns to step 801 and waits for the next processing time interval.

The described approach of the audio capturing apparatus of FIG. 5-7 may provide advantageous performance in many scenarios and in particular may tend to allow the audio capturing apparatus to dynamically form focused, robust, and accurate beams to capture audio sources. The beams will tend to be adapted to cover different regions and the approach may e.g. automatically select and adapt the nearest constrained beamformer 509, 511.

Figure 2:
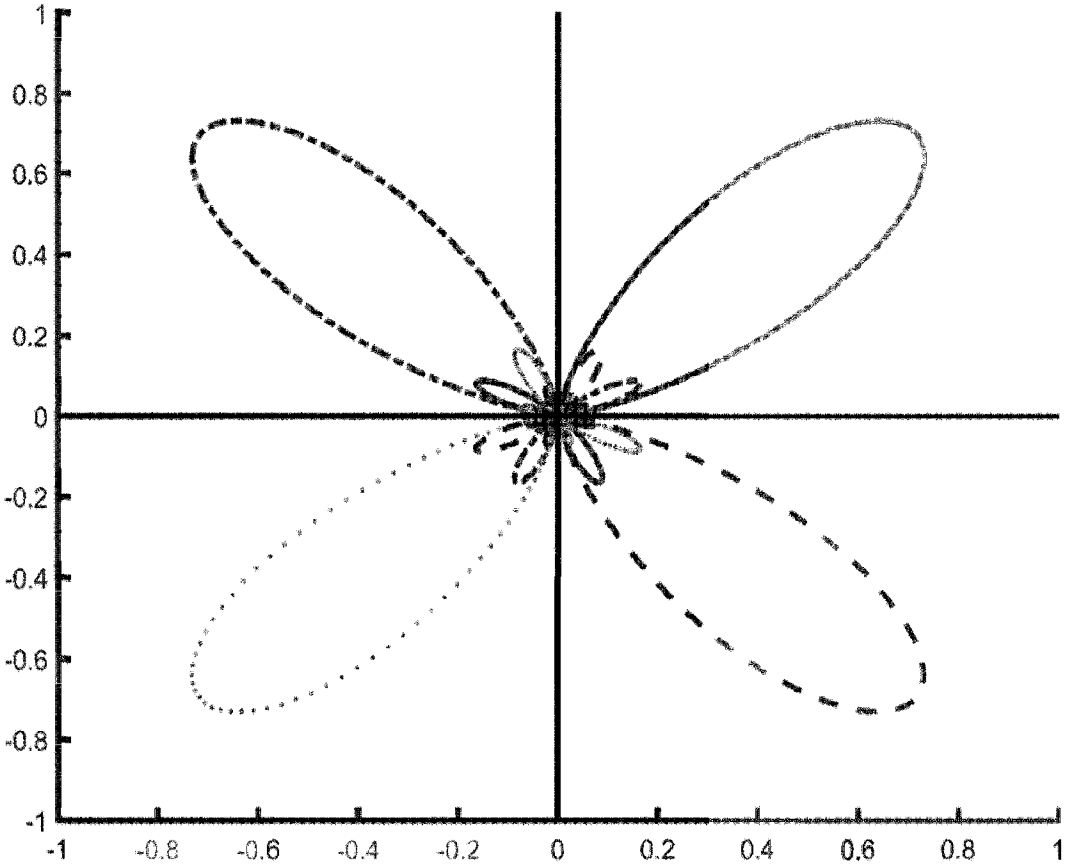
Prior Art FIG. 2
FIG. 2 illustrates an example of a plurality of beams formed by an audio capturing system.

Thus, in contrast to the approach of e.g. FIG. 2, no specific constraints on the beam directions or on the filter coefficients need to be directly imposed. Rather, separate regions can automatically be generated/formed by letting the constrained beamformers 509, 511 only adapt (conditionally) when there is a single audio source dominant and when it is sufficiently close to the beam of the constrained beamformer 509, 511. This can specifically be determined by considering the filter coefficients which take into account both the direct field and the (first) reflections.

It should be noted that using filters with an extended impulse response (as opposed to using simple delay filters, i.e. single coefficient filters) also takes into account that reflections arrive some (specific) time after the direct field. Accordingly, a beam is not only determined by spatial characteristics (from which directions the direct field and reflections arrive from) but is also determined by temporal characteristics, (at which times after the direct field do reflections arrive). Thus, references to beams are not merely restricted to spatial considerations but also reflect the temporal component of the beamform filters. Similarly, the references to regions include both the purely spatial as well as the temporal effects of the beamform filters.

The approach can thus be considered to form regions that are determined by the difference in the distance measure between the free running beam of the first beamformer 505 and the beam of the constrained beamformer 509, 511. For example, suppose a constrained beamformer 509, 511 has a beam focused on a source (with both spatial and temporal characteristics). Suppose the source is silent and a new source becomes active with the first beamformer 505 adapting to focus on this. Then every source with spatio-temporal characteristics such that the distance between the beam of the first beamformer 505 and the beam of the constrained beamformer 509, 511 does not exceed a threshold can be considered to be in the region of the constrained beamformer 509, 511. In this way, the constraint on the first constrained beamformer 509 can be considered to translate into a constraint in space. The distance criterion for adaptation of a constrained beamformer together with the approach of initializing beams (e.g. copying of beamform filter coefficients) typically provides for the constrained beamformers 509, 511 to form beams in different regions.

The approach typically results in the automatic formation of regions reflecting the presence of audio sources in the environment rather than a predetermined fixed system as that of FIG. 2. This flexible approach allows the system to be based on spatio-temporal characteristics, such as those caused by reflections, which would be very difficult and complex to include for a predetermined and fixed system (as these characteristics depend on many parameters such as the size, shape and reverberation characteristics of the room etc).

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc. do not preclude a plurality. Reference signs in the claims are provided merely as a clarifying example shall not be construed as limiting the scope of the claims in any way.

The invention claimed is:

1. A beamforming audio capture apparatus comprising:
a microphone array;
a first beamformer,
wherein the first beamformer is coupled to the microphone array,
wherein the first beamformer is arranged to generate a first beamformed audio output,
wherein the first beamformer is a first filter-and-combine beamformer,
wherein the first filter-and-combine beamformer comprises a first plurality of beamform filters,
wherein each of the first plurality of beamform filters has a first adaptive impulse response;
a second beamformer,
wherein the second beamformer is coupled to the microphone array,
wherein the second beamformer is arranged to generate a second beamformed audio output,
wherein the second beamformer is a second filter-and-combine beamformer,
wherein the second filter-and-combine beamformer comprises a second plurality of beamform filters,
wherein each of the second plurality of beamform filters has a second adaptive impulse response; and
a difference processor circuit, wherein the difference processor circuit is arranged to determine a difference measure between at least one beam of the first beamformer and at least one beam of the second beamformer in response to a comparison of the first adaptive impulse responses to the second adaptive impulse responses.

2. The beamforming audio capture apparatus of claim 1,
wherein the difference processor circuit is arranged to for each microphone of the microphone array determine a correlation between the first adaptive impulse response and the second adaptive impulse response,
wherein the difference processor circuit is arranged to determine the difference measure in response to a combination of correlations for each microphone of the microphone array.

3. The beamforming audio capture apparatus of claim 1,
wherein the difference processor circuit is arranged to determine frequency domain representations of the first adaptive impulse responses and of the second adaptive impulse responses,
wherein the difference processor circuit is arranged to determine the difference measure in response to the frequency domain representations of the first adaptive impulse responses and of the second adaptive impulse responses.

4. The beamforming audio capture apparatus of claim 3,
wherein the difference processor circuit is arranged to determine frequency difference measures for frequencies of the frequency domain representations, wherein the difference processor circuit is arranged to determine the difference measure in response to the frequency difference measures for the frequencies of the frequency domain representations, wherein the difference processor circuit is arranged to determine a frequency difference measure for a first frequency and a first microphone of the microphone array in response to a first frequency domain coefficient and a second frequency domain coefficient, wherein the first frequency domain coefficient is a frequency domain coefficient for the first frequency for the first adaptive impulse response for the first microphone, wherein the second frequency domain coefficient is a frequency domain coefficient for the first frequency for the second adaptive impulse response for the first microphone, wherein the difference processor circuit is arranged to determine the frequency difference measure for the first frequency in response to a combination of frequency difference measures for a plurality of microphones of the microphone array.

5. The beamforming audio capture apparatus of claim 4, wherein the difference processor circuit is arranged to determine the difference measure as a frequency selective weighted sum of the frequency difference measures.

6. The beamforming audio capture apparatus of claim 4, wherein the difference processor circuit is arranged to determine the frequency difference measure for the first frequency and the first microphone in response to a multiplication of the first frequency domain coefficient and a conjugate of the second frequency domain coefficient.

7. The beamforming audio capture apparatus of claim 6, wherein the difference processor circuit is arranged to determine the frequency difference measure for the first frequency in response to a real part of the combination of frequency difference measures for the first frequency for the plurality of microphones of the microphone array.

8. The beamforming audio capture apparatus of claim 7, wherein the difference processor circuit is arranged to determine the frequency difference measure for the first frequency in response to at least one of a real part and a norm of the combination of frequency difference measures for the first frequency for the plurality of microphones of the microphone array relative to a sum of a function of an L2 norm for a sum of the first frequency domain coefficients and a function of an L2 norm for a sum of the second frequency domain coefficients for the plurality of microphones of the microphone array.

9. The beamforming audio capture apparatus of claim 7, wherein the difference processor circuit is arranged to determine the frequency difference measure for the first frequency in response to a norm of the combination of frequency difference measures for the first frequency for the plurality of microphones of the microphone array relative to a product of a function of an L2 norm for a sum of the first frequency domain coefficients and a function of an L2 norm for a sum of the second frequency domain coefficients for the plurality of microphones of the microphone array.

10. The beamforming audio capture apparatus of claim 6, wherein the difference processor is arranged to determine the frequency difference measure for the first frequency in response to a norm of the combination of frequency difference measures for the first frequency for the plurality of microphones of the microphone array.

11. The beamforming audio capture apparatus of claim 10, wherein the difference processor circuit is arranged to determine the frequency difference measure for the first frequency in response to at least one of a real part and a norm of the combination of frequency difference measures for the first frequency for the plurality of microphones of the microphone array relative to a sum of a function of an L2 norm for a sum of the first frequency domain coefficients and a function of an L2 norm for a sum of the second frequency domain coefficients for the plurality of microphones of the microphone array.

12. The beamforming audio capture apparatus of claim 10, wherein the difference processor circuit is arranged to determine the frequency difference measure for the first frequency in response to a norm of the combination of frequency difference measures for the first frequency for the plurality of microphones of the microphone array relative to a product of a function of an L2 norm for a sum of the first frequency domain coefficients and a function of an L2 norm for a sum of the second frequency domain coefficients for the plurality of microphones of the microphone array.

13. The beamforming audio capture apparatus of claim 1, wherein the first plurality of beamform filters and the second plurality of beamform filters are finite impulse response filters.

14. The beamforming audio capture apparatus of claim 1 further comprising:

a plurality of constrained beamformers, wherein the plurality of constrained beamformers are coupled to the microphone array and each arranged to generate a constrained beamformed audio output, wherein each constrained beamformer of the plurality of constrained beamformers is constrained to form beams in a region different from regions of other constrained beamformers from the plurality of constrained beamformers, wherein the second beamformer is a constrained beamformer of the plurality of constrained beamformers;

a first adapter circuit, wherein the first adapter circuit is arranged to adapt beamform parameters of the first beamformer; and a second adapter circuit, wherein the second adapter circuit is arranged to adapt constrained beamform parameters for the plurality of constrained beamformers, wherein the second adapter circuit is arranged to adapt constrained beamform parameters only for constrained beamformers of the plurality of constrained beamformers for which a difference measure has been determined that meets a similarity criterion.

15. The beamforming audio capture apparatus of claim 14 further comprising an audio source detector, wherein the audio source detector is arranged to detect point audio sources in the second beamformed audio output, wherein the second adapter circuit is arranged to adapt constrained beamform parameters only for constrained beamformers for which a presence of a point audio source is detected in the constrained beamformed audio output.

16. A method of operation for a beamforming audio capture apparatus wherein the audio capture apparatus comprises:

a microphone array;

a first beamformer, wherein the first beamformed is coupled to the microphone array, wherein the first beamformer is a first filter-and-combine beamformer, wherein the first filter-and-combine beamformer comprises a first plurality of beamform filters, wherein each of the first plurality of beamform filters have a first adaptive impulse response;

a second beamformer coupled to the microphone array, wherein the second beamformer is a second filter-and-combine beamformer, wherein the second filter-and-combine beamformer comprises a second plurality of beamform filters, wherein each of the second plurality of beamform filters have an adaptive impulse response; the method comprising:

generating a first beamformed audio output, using the first beamformer;

generating a second beamformed audio output, using the second beamformer; and determining a difference measure between beams of the first beamformer and the second beamformer in response to a comparison of the first adaptive impulse responses to the second adaptive impulse responses.

17. A computer program product comprising computer program code stored in a non-transitory media, wherein the computer code is arranged to perform all the steps of claim 16 when the program is run on a computer.

* * * * *